US006412324B2

(12) United States Patent
Sahlem

(10) Patent No.: US 6,412,324 B2
(45) Date of Patent: Jul. 2, 2002

(54) APPARATUS AND METHOD FOR FORMING A DOUBLE ENDED UPSET PIPE

(75) Inventor: Donald P. Sahlem, Akron, NY (US)

(73) Assignee: Wyman-Gordon Company, Millbury, MA (US)

( * ) Notice: Subject to any disclaimer, the term of this patent is extended or adjusted under 35 U.S.C. 154(b) by 0 days.

(21) Appl. No.: 09/730,482

(22) Filed: Dec. 5, 2000

Related U.S. Application Data

(63) Continuation-in-part of application No. 09/414,026, filed on Oct. 7, 1999, now Pat. No. 6,155,092.
(60) Provisional application No. 60/103,798, filed on Oct. 9, 1998.

(51) Int. Cl.[7] ..... B21C 25/08
(52) U.S. Cl. ..... 72/260; 72/264; 72/368; 72/370.08; 72/370.14; 72/462
(58) Field of Search ..... 72/260, 264, 266, 72/367.1, 368, 370.01, 370.06, 370.08, 370.14, 370.15, 370.23, 370.24, 462

(56) References Cited

U.S. PATENT DOCUMENTS 2,391,766 A 12/1945 Barnhart (List continued on next page.)

FOREIGN PATENT DOCUMENTS

DE 926 482 4/1955

(List continued on next page.)

OTHER PUBLICATIONS

Notification of Transmittal of International Search Report (PCT/US99/23618) dated Feb. 15, 2000.
Written Opinion (PCT/US99/23618) dated Sep. 20, 2000.

*Primary Examiner*—Ed Tolan
(74) *Attorney, Agent, or Firm*—Blodgett & Blodgett, P.C.

(57) ABSTRACT

Apparatus for and method of extruding a metal pipe having a substantially uniform inner diameter. The forward and rearward end sections of the pipe are thicker than the middle section of the pipe. A heated metal billet having a cylindrical longitudinal bore is inserted into the rear opening of a cylindrical bore of a stationary container. A two-part removable inner die is located within the bore of the container adjacent the forward end of the container and an outer die is located outside of the container adjacent the front end of the container. The inner die has a relatively small diameter cylindrical bore. The outer die has a relatively large diameter cylindrical bore. The billet is moved along a central longitudinal axis within the bore of the container by a press which includes a circular forward pressing surface and a mandrel extending forwardly from the pressing surface toward the billet. The mandrel has a cylindrical relatively large diameter rearward portion, a cylindrical relatively small diameter middle portion and a frusto conical forward portion which tapers outwardly in the forward direction from the diameter of the middle portion to the diameter of the forward portion. Metal from the billet is forced through the bore of the inner die around the small diameter portion of the mandrel by moving the press forwardly for a first distance for extruding a preliminary forward end section of pipe. The press is moved forwardly for a second distance for forcing metal from the billet through the bore of the inner die around the large diameter rearward portion of the mandrel for extruding the middle section of pipe and causing the preliminary forward end section of pipe to pass over the tapered forward portion of the mandrel. This causes the preliminary forward end section of pipe to be expanded transversely of its central longitudinal axis to an inner diameter which is equal to the inner diameter of the middle section and a wall thickness which is greater than the wall thickness of the middle section of pipe. The inner die is removed from the container and the press is moved forwardly for a third distance for forcing metal from the billet through the bore of the outer die around the rearward portion of the mandrel to extrude the rearward end section of pipe having an inner diameter which is equal to the inner diameter of the middle section of pipe and a wall thickness which is greater than the wall thickness of the middle section of pipe.

5 Claims, 19 Drawing Sheets

U.S. PATENT DOCUMENTS

| | | | | | |
|---|---|---|---|---|---|
| 2,778,493 | A | | 1/1957 | Kreidler | |
| 3,096,579 | A | | 7/1963 | Waller | |
| 3,176,494 | A | | 4/1965 | Cullen et al. | |
| 3,690,141 | A | * | 9/1972 | Brownbill | 72/370.08 |
| 3,950,979 | A | | 4/1976 | Fuchs, Jr. | |
| 4,206,626 | A | | 6/1980 | Groos et al. | |
| 4,292,831 | A | | 10/1981 | Simon | |
| 4,674,171 | A | * | 6/1987 | DeCell et al. | 72/368 |
| 5,040,405 | A | * | 8/1991 | Honma et al. | 72/462 |
| 5,522,246 | A | | 6/1996 | Simon | |
| 5,533,375 | A | | 7/1996 | Chen et al. | |
| 5,901,594 | A | * | 5/1999 | Wasson et al. | 72/370.08 |
| 6,155,092 | A | * | 12/2000 | Sahlem | 72/260 |

FOREIGN PATENT DOCUMENTS

| | | |
|---|---|---|
| EP | 0 384 641 | 8/1990 |
| GB | 643857 | 9/1950 |
| GB | 738762 | 10/1955 |
| GB | 890012 | 2/1962 |
| JP | 39-832 | 1/1964 |

* cited by examiner

APPARATUS AND METHOD FOR FORMING A DOUBLE ENDED UPSET PIPE

CROSS-REFERENCE TO RELATED APPLICATIONS

This application claims the benefit under 35 U.S.C. §119 (e) of prior U.S. Provisional Application No. 60/103,798 filed Oct. 9, 1998; and is a continuation in part of U.S. patent application Ser. No. 09/414,026, now U.S. Pat. No. 6,155,092 filed Oct. 7, 1999; all of which is are hereby incorporated by reference.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention is directed to an apparatus for forming a fluid conveying pipe known in the trade as a "double ended upset pipe". Such a pipe has a forward, or "pin" end section, an elongated middle section and a rearward, or "box" end section. The inner diameters of all three sections of the pipe are the same. The outer diameters of the forward and rearward end sections of the pipe are substantially greater than the outer diameter of the middle section of pipe. Therefore, the thickness of the middle section of the pipe is substantially thinner than either of the forward and rearward end sections of the pipe. The extra thickness of the forward and rearward end section of the pipe is machined and/or threaded to enable the forward, or "pin" end of a first pipe to be coupled to the rearward or "box" end of a second pipe.

In the past, metallic double ended upset pipes have been formed by extruding the middle and end sections of the pipe separately and welding the forward and rearward end sections to opposite ends of the middle section. Since the welded areas represent potentially weak areas of the pipe, each section of the pipe is made thicker than that which would normally be needed. This procedure is time consuming and expensive. The extra thickness which requires extra material also adds a material cost to the pipe. The added weight of the pipe adds still further costs in shipping and handling.

Many metal extrusion devices and methods have been developed for extruding a pipe from a billet with the use of a press, a die, and a mandrel. However, there is no known apparatus or system for extruding an integral pipe having a uniform inside diameter in which the opposite end sections of the pipe have an outside diameter greater than the outside diameter of the middle section of the pipe. These and other difficulties experienced with the prior art pipe extruding devices or methods have been obviated by the present invention.

It is, therefore, a principal object of the invention to provide an apparatus for extruding a pipe from a metal billet for producing an integrally formed pipe having a constant or uniform inside diameter and a middle section which has a smaller outside diameter than the outside diameter of each of the opposite end section of the pipe.

A further object of the invention is the provision of an apparatus for extruding a pipe from a metal billet as described above in a single continuous extrusion operation.

Another object of the present invention is the provision of a method of extruding a pipe from a metal billet in which the pipe has uniform inside diameter and a middle section having a smaller outside diameter than the outside diameter of the opposite end sections of the pipe.

A still further object of the invention is the provision of a method of extruding from a metal billet a pipe as defined above in a single continuous process.

Still another object of the invention is the provision of having an outside non-uniform configuration mandrel for use in a metal extrusion machine for extruding from a metal billet a pipe having a uniform inside diameter and a middle section which has a smaller outside diameter than the outside diameter of the opposite end sections of the pipe.

Another object of the invention is the provision of an apparatus for extruding a pipe from a metal billet wherein the middle section of the pipe has a smaller outside diameter than the outside diameter of each of the opposite end sections of the pipe and one end section of the pipe has a smaller inner diameter that the inner diameter of the middle section and opposite end section of the pipe.

With these and other objects in view, as will be apparent to those skilled in the art, the invention resides in the combination of parts set forth in the specification and covered by the claims appended hereto.

BRIEF SUMMARY OF THE INVENTION

Apparatus for and method of extruding a metal pipe having a substantially uniform inner diameter. The forward and rearward end sections of the pipe are thicker than the middle section of the pipe. A heated metal billet having a cylindrical longitudinal bore is inserted into the rear opening of a cylindrical bore of a stationary container. A two-part removable inner die is located within the bore of the container adjacent the forward end of the container and an outer die is located outside of the container adjacent the front end of the container. The inner die has a relatively small diameter cylindrical bore. The outer die has a relatively large diameter cylindrical bore. The billet is moved along a central longitudinal axis within the bore of the container by a press which includes a circular forward pressing surface and a mandrel extending forwardly from the pressing surface toward the billet. The mandrel has a cylindrical relatively large diameter rearward portion, a cylindrical relatively small diameter middle portion and a frusto conical forward portion which tapers outwardly in the forward direction from the diameter of the middle portion to the diameter of the forward portion. Metal from the billet is forced through the bore of the inner die around the small diameter portion of the mandrel by moving the press forwardly for a first distance for extruding a preliminary forward end section of pipe. The press is moved forwardly for a second distance for forcing metal from the billet through the bore of the inner die around the large diameter rearward portion of the mandrel for extruding the middle section of pipe and causing the preliminary forward end section of pipe to pass over the tapered forward portion of the mandrel. This causes the preliminary forward end section of pipe to be expanded transversely of its central longitudinal axis to an inner diameter which is equal to the inner diameter of the middle section and a wall thickness which is greater than the wall thickness of the middle section of pipe. The inner die is removed from the container and the press is moved forwardly for a third distance for forcing metal from the billet through the bore of the outer die around the rearward portion of the mandrel to extrude the rearward end section of pipe having an inner diameter which is equal to the inner diameter of the middle section of pipe and a wall thickness which is greater than the wall thickness of the middle section of pipe.

BRIEF DESCRIPTION OF THE DRAWINGS

The character of the invention, however, may be best understood by reference to one of its structural forms, as illustrated by the accompanied drawings, in which.

DETAILED DESCRIPTION OF THE INVENTION

Figure 1:
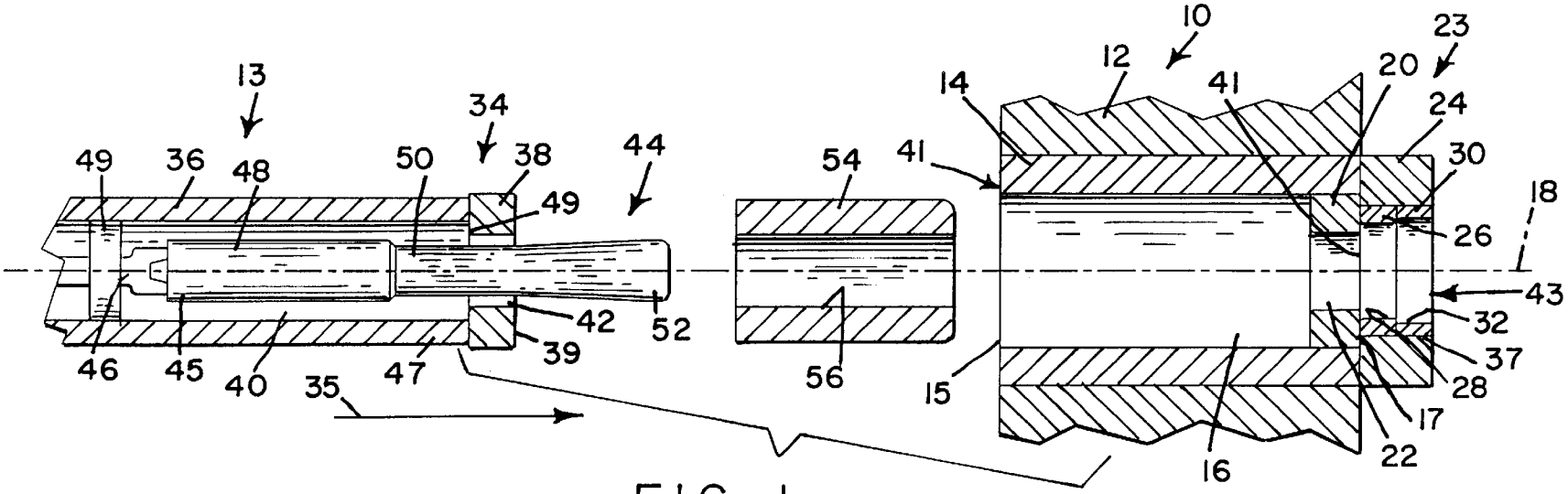
FIG. 1 is a longitudinal cross-sectional view of the primary functional components of the extruding apparatus of the present invention for forming a double ended upset pipe.

Referring first to FIGS. 19*a*, 19*b*, 19*c*, and 19*d*, the pipe extruding apparatus of the present invention is generally indicated by the reference 10. Apparatus 10 comprises a rearward machine base 72, and a forward machine base 72 connected to the rearward machine base by four connecting rods 74. A press, generally indicated by the reference numeral 13, is mounted on the pipe extruding apparatus 10 between the machine bases 70 and 72 for longitudinal movement along central longitudinal axis 18.

Press 13 includes a crosshead 78 located between the machine base 70 and 72. A piston 75 is connected to the rearward side of the crosshead 78 through a horizontal connector 79. Piston 75 is slidably mounted within a single acting hydraulic cylinder 77 which is fixed to the rearward machine base 72. Cylinder 77 is connected to a high pressure hydraulic source, not shown, through hydraulic line 73. Crosshead 78 is supported on a pair of longitudinal ways 81 and guided on the connecting rails 74 for longitudinal forward and rearward movement along the longitudinal axis 18. Crosshead 78 has a horizontal bore 65 which is coaxial with longitudinal axis 18. A double acting hydraulic cylinder 81 is fixed to the hydraulic cylinder 77 through a structural support 82. A piston, generally indicated by the reference numeral 85, includes a piston head 89 slidably mounted within the cylinder 81 and a piston rod 93 extending from the cylinder 81 and fixed to the upper end of the crosshead 78. Cylinder 81 is connected to a high pressure hydraulic source, not shown, through hydraulic lines 76. Actuation of cylinder 77 causes the piston 75 and the crosshead 78 to move forwardly toward the forward machine base 70. The relatively large size of the cylinder 77 provides the large forces required to force a billet through the die structure to be described at the forward end of the extruder. The crosshead 78 and the piston 75 are moved rearwardly to their starting positions by actuating the cylinder 81 so that the head 89 is moved rearwardly within the cylinder 81. Press 13 also includes a cylindrical housing or stem 36 that is fixed to the forward side of crosshead 78 and extends forwardly along the longitudinal axis 18. A double acting hydraulic cylinder 69 is fixed to the rearward side of crosshead 78 and connected to the high pressure hydraulic source through hydraulic lines 68.

Stem 36 has a chamber 40 and a forward end 47 which contains a forward opening 49 to the chamber 40. A pressing ring 38 is located at the forward opening 49 of the housing 36 and contains a cylindrical bore 42 and a circular forward pressing surface 39. A mandrel 44 is located within the chamber 40 and has a rearward end 45 configured to be coupled to the forward end of a driving rod 46. A bushing 59 is fastened to the forward end of the driving rod 46 with a clearance fit within the stem 36. This helps to support the driving rod 46 and maintains the mandrel 44 on center. The rearward end of the driving rod 46 is coupled to a piston 71 which is slidably mounted within the cylinder 69. The cylinder 69 enables the mandrel 44 to be selectively moved forwardly and rearwardly along the longitudinal axis 18 relative to the stem 36. The mandrel 44 is coaxial about the central longitudinal axis 18. The mandrel 44 has a cylindrical rearward portion 48, a reduced diameter cylindrical middle portion 50, and a frusto conical forward portion 52 which tapers outwardly from the reduced diameter middle portion 50 to the forward end of the mandrel. The extreme forward end of the mandrel 44 has the same diameter as that of the rearward portion 48. The mandrel 44 extends freely through the bore 42 of the pressing ring 38. The pressing ring 38 is not attached to the stem 36 and is supported on the mandrel 44.

Figure 3:
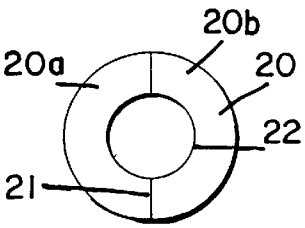
FIG. 3 is an end view of a two-part die which also forms a portion of the apparatus.
Figure 2:
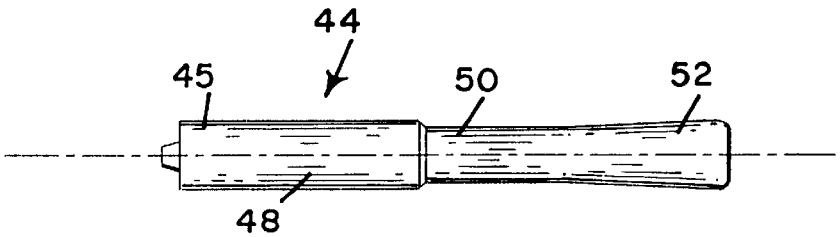
FIG. 2 is a side elevational view of the mandrel portion of the apparatus.

A housing or container 12 is supported on the forward machine base 70. The housing 12 is fixed to a pair of oppositely extruding connecting arms 80. Connecting arms 80 are fixed to the rearwardly extending ends 85 of a pair of pistons, generally indicated by the reference numeral 84. The forward ends of pistons 84 are slidably mounted within double acting hydraulic cylinders 88 which are connected to the high pressure hydraulic source through hydraulic lines 90. The hydraulic cylinders 88 are fixed to the forward machine base 70. The housing 12 contains a cylindrical tube or liner 14 having a circular bore 16 which is coaxial with the longitudinal axis 18. The bore 16 has a circular rear opening 15 and a circular front opening 17. Referring also to FIGS. 1 and 3, a cylindrical inner die 20 is located within the bore 16 adjacent the front opening 17 of the bore. The inner die 20 is divided transversely along the line 21 to form two separable halves 20*a* and 20*b*. An outer die assembly, generally indicated by the reference numeral 23, is located outside of the front opening 17 of the bore 16. The outer die assembly 23 includes a die holder 24 which has a bore 37, a rearward end 41, and a forward end 43. An outer die 26 is located within the bore 37 at the rearward end 41 of the die holder 24. A back plate 30 is located at the forward end 43 of the die holder 24. The outer die 26 has a circular bore 28. The back plate 30 has a circular bore 32. The diameter of the bore 32 is slightly larger than the diameter of the bore 28. The bore 22 of the inner die 20 has a smaller diameter than the diameter of the bore 28.

The pipe which is to be formed by the extruding apparatus 10 of the present invention is formed from a cylindrical billet 54 that has a cylindrical longitudinal bore 56. The size of the billet 54 is such that there is a specified amount of clearance between the outer surface of the billet relative to the inner surface of the liner 14 which defines the bore 16. The diameter of the bore 56 of billet 54 has a specified clearance relative to the outer diameter of the portions 48 and 52 of the mandrel. The stem 36 of the press 13 moves along the axis 18 and applies all of the forward force of the press 13 to the billet 54.

The outer die assembly 23 is located within a retaining ring 92 which is located at the rearward end of a removable housing or outer die carrier 98. Die carrier 98 is located within a horizontal chamber 100 in the forward machine base 70. Chamber 100 has a rear opening 103 and a forward opening 99. Carrier 98 has a central horizontal bore 97 that has a forward opening 86 and a rearward opening 87. The rearward portion of the bore 97 has a counterbore 96 which contains the retaining ring 92 and outer die assembly 23. A retaining plate 94 is located at the forward end of the counterbore portion of the bore 97. Retaining plate 94 has a bore 91 which has a larger diameter than the bore 32 of the back plate 30.

Figure 19A:
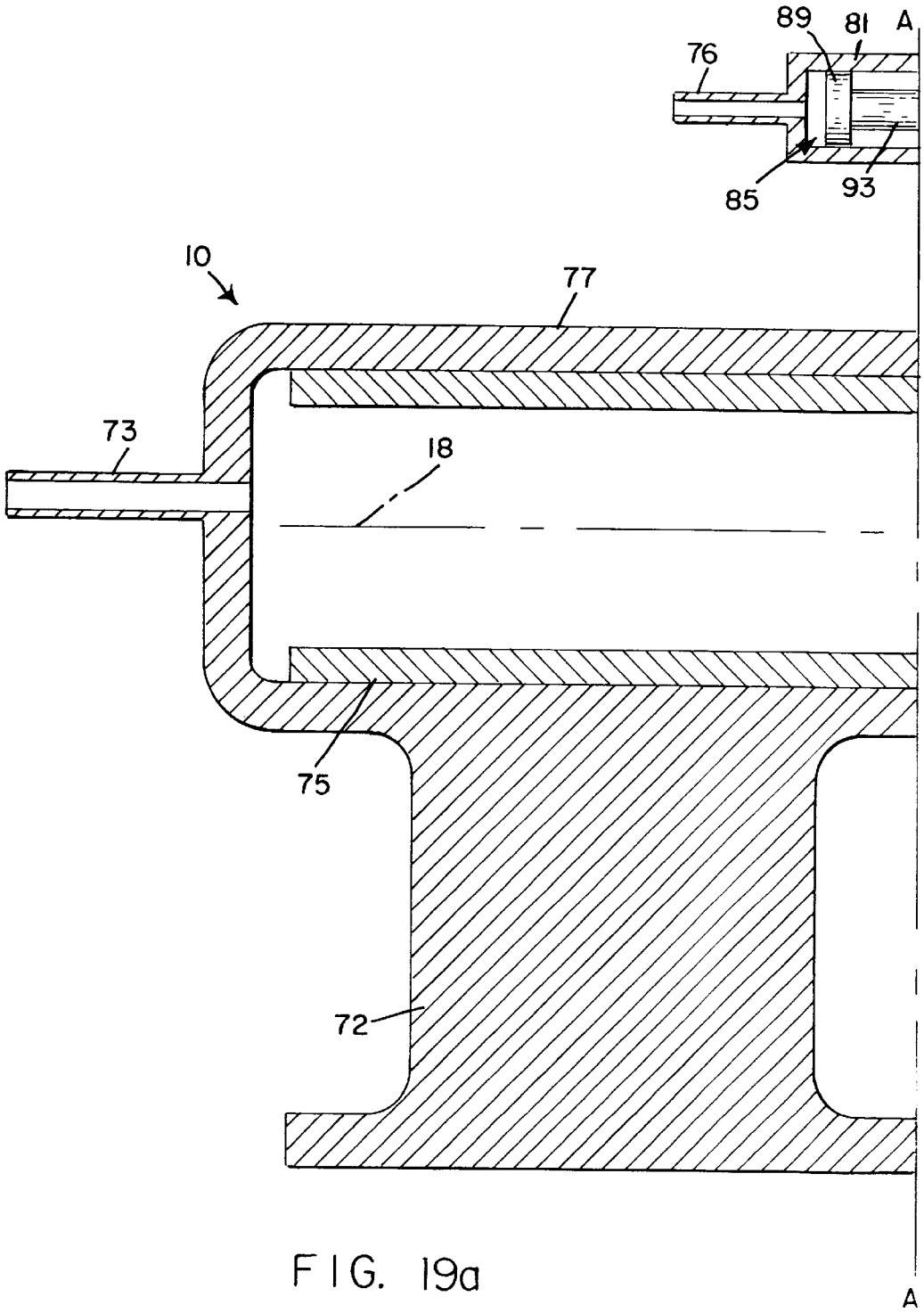
FIGS. 19*a*, 19*b*, 19*c*, and 19*d* are vertical cross-sectional views which may be joined together along the common lines A—A, B—B, and C—C and showing the overall extruding apparatus of the present invention.
Figure 19B:
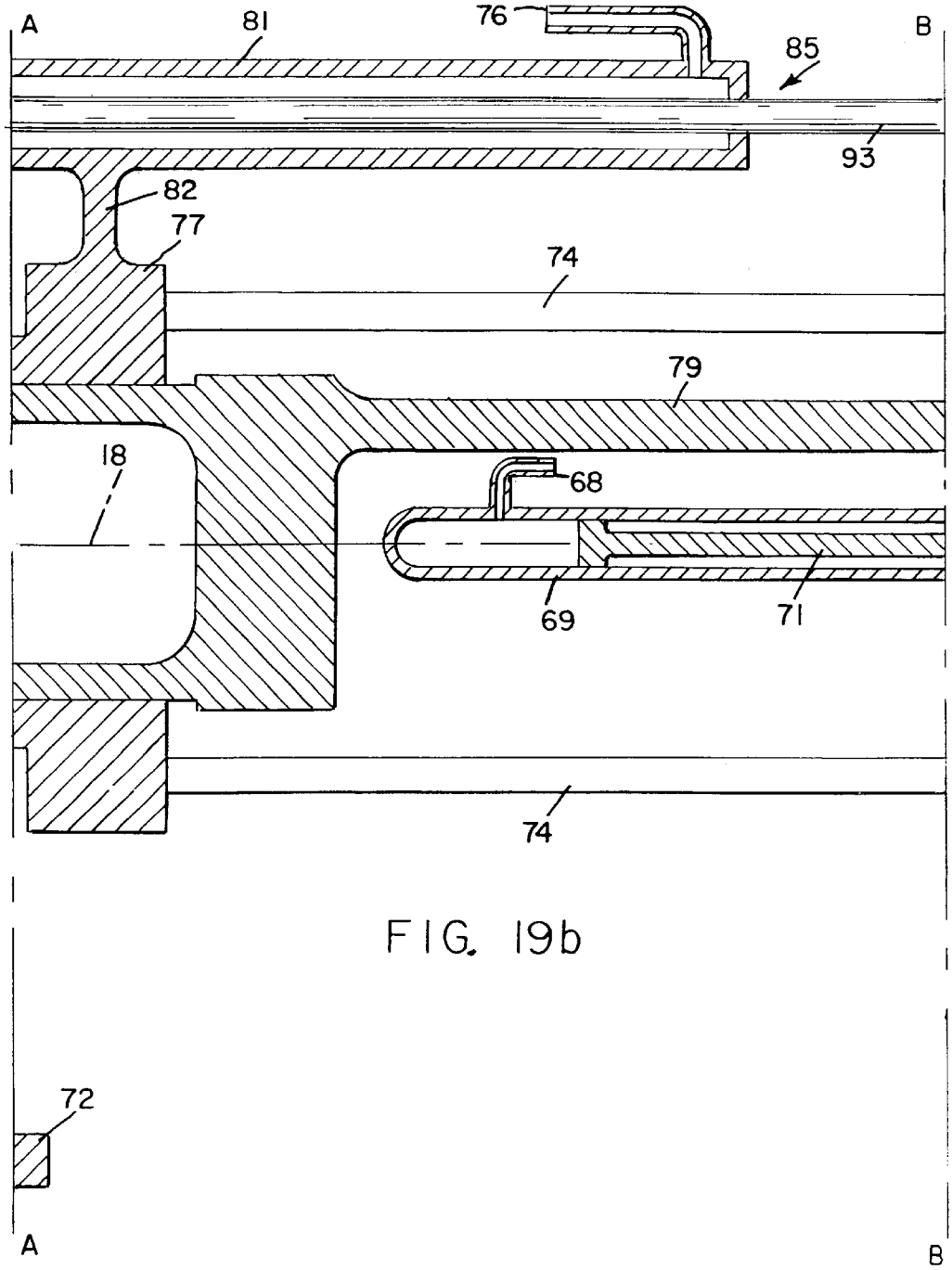
Figure 19C:
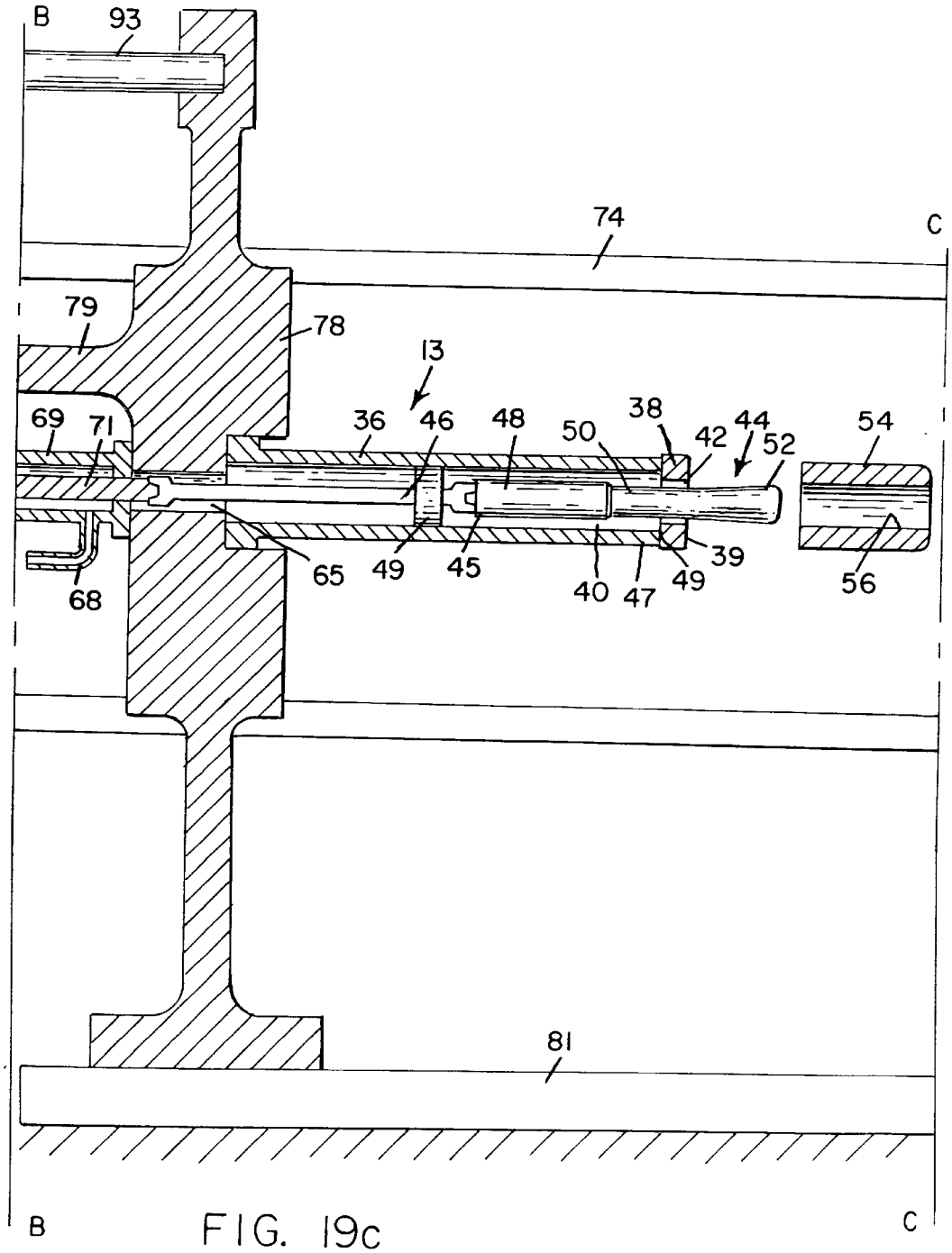
Figure 19D:
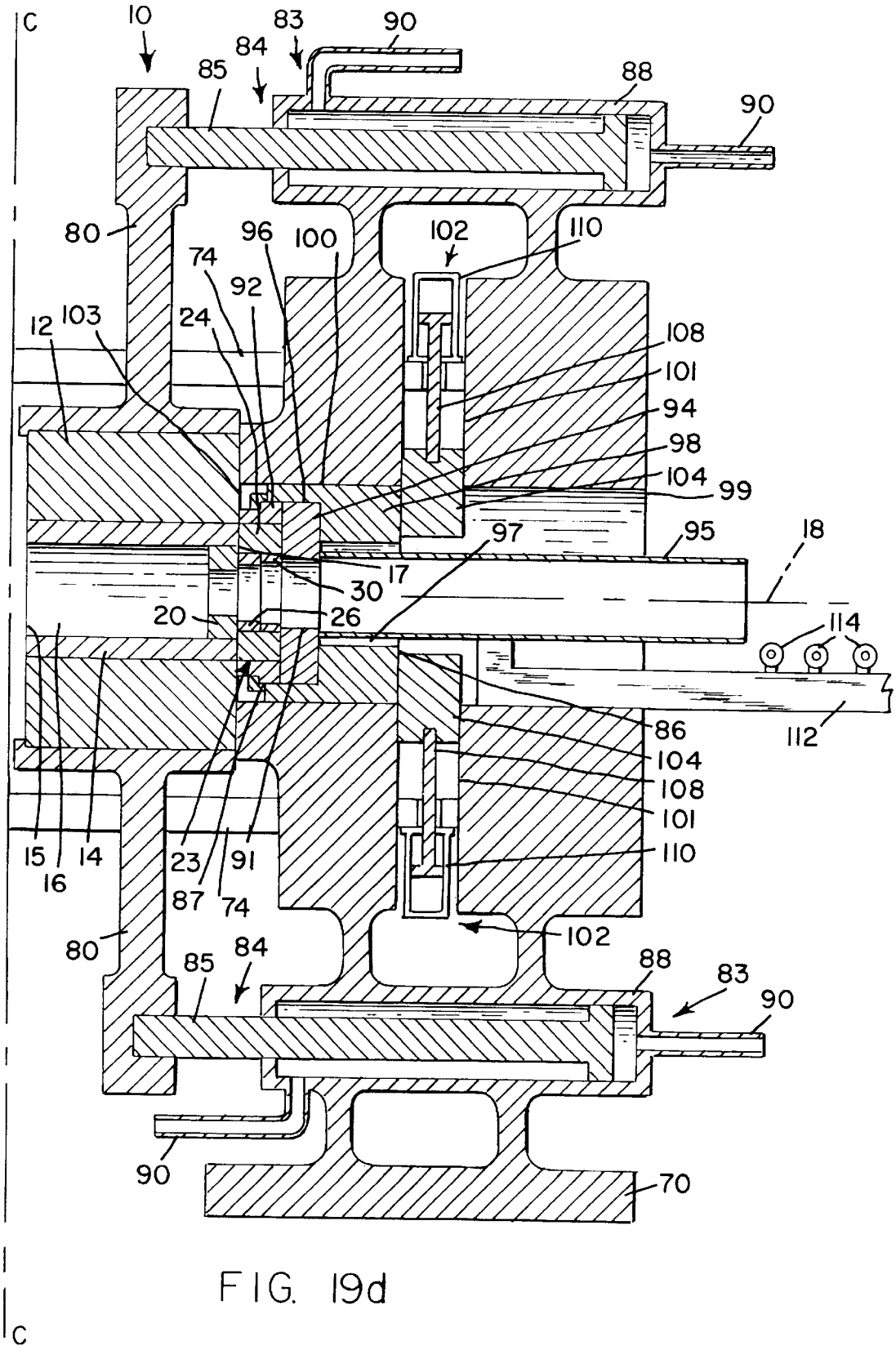

The outer die carrier 98 is maintained at the rearward end of the chamber 100 by a releasable stop mechanism, generally indicated by the reference numeral 102. Stop mechanism 102 includes a pair of oppositely facing gates 104 slidably mounted within transverse bores 101 which intersect the chamber 100. Each gate 104 is connected to one end of a piston 108. The opposite end of each piston 108 is slidably mounted within a hydraulic cylinder 110. Each hydraulic cylinder 110 is fixed to the forward machine base 70. the hydraulic cylinders 110 can be controlled for selectively moving the gates 104 between an active position, as shown in FIG. 19*d*, in which the gates 104 are located within the chamber 100 to an inactive position in which the gates 104 are outside of the chamber 100. When the gates 104 are in their active positions, they block any forward movement of the outer die carrier 98 and maintain the outer die assembly 23 against the forward end of the container 12 and the inner die 20. When the gates 104 are in their inactive positions, the outer die carrier 98 can be removed from the chamber 100 through the front opening 99.

A guide tube 95 is fixed to the forward side of the retaining plate 94. Guide tube 45 is coaxial with the longitudinal axis 18 and extends forwardly through the front opening 99. A table 112 is fixed to the guide tube 95 and extends below the tube 95. A plurality of guide rollers 114 are located on the upper surface of the table 112.

Having described the details of the pipe forming apparatus of the present invention, a double ended upset pipe blank is formed in accordance with the following description.

Figure 4:
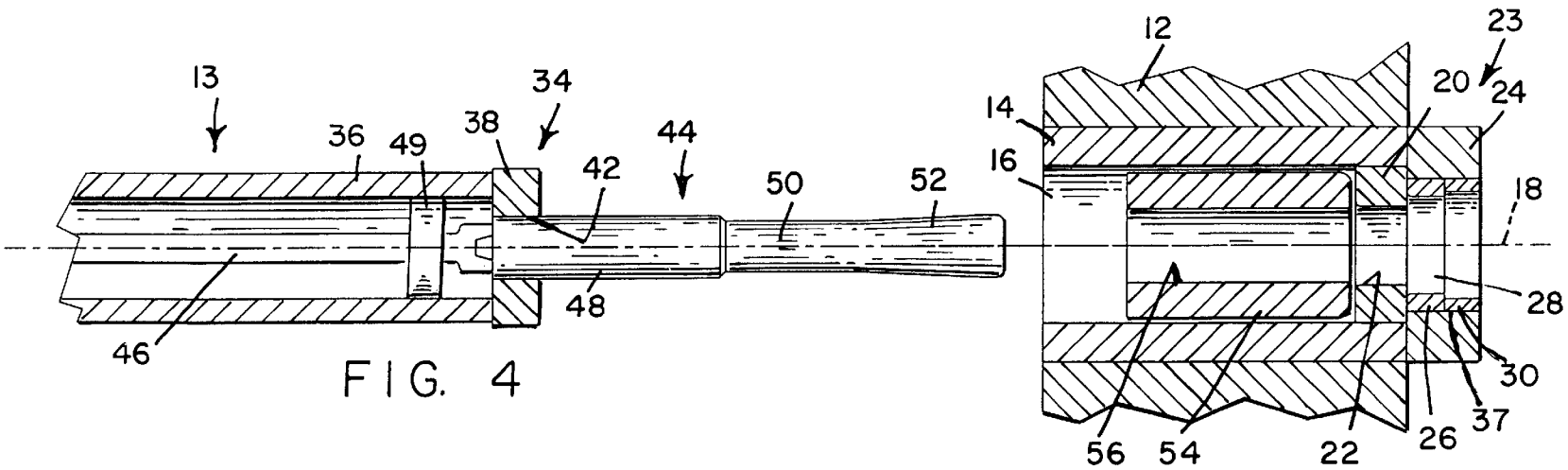
FIGS. 4–12 are operational views illustrating the formation of the forward and middle sections of the pipe.
Figure 5:
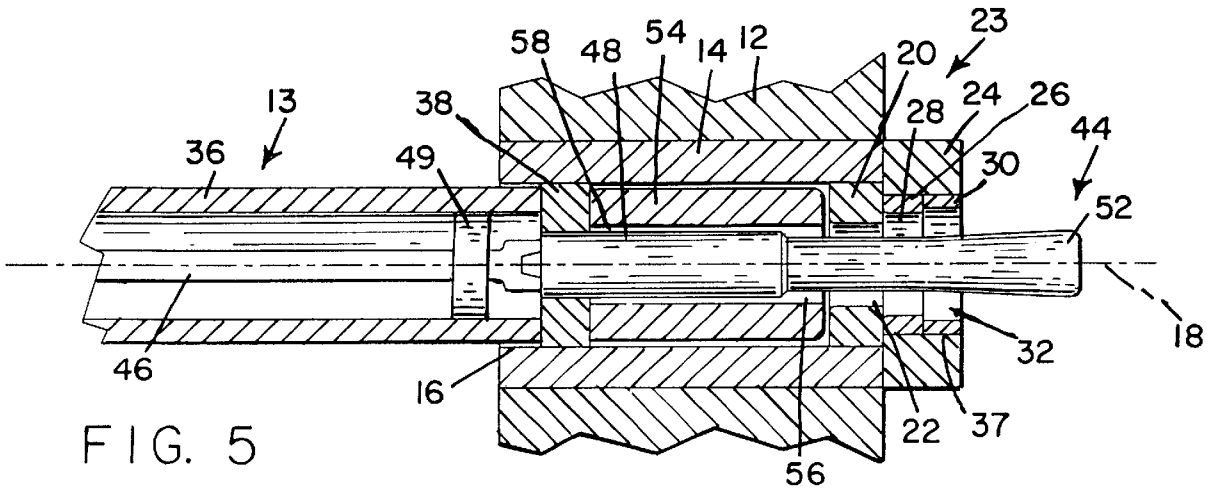

Referring to FIG. 1, the mandrel 44 is shown retracted into the stem 36 to enable the billet 54 to be positioned between the mandrel 44 and the opening 15 of the chamber 16. The billet 54 is then loaded into the bore 16 of the container 12. Once the billet 54 has been loaded into the bore 16, as shown in FIG. 4, the cylinder 69 is actuated to force the driver 46 forwardly relative to the crosshead 78 and stem 36. The mandrel 44 is thereby extended forwardly by the driver 46, relative to the stem 36, so that the rearward portion 48 of the mandrel is at the forward end of the stem 36 and within the bore 42 of the pressing ring 38. At this point, the mandrel 44 is maintained in a fixed position relative to the ring 38. The cylinder 77 is actuated to move the press 13, comprising crosshead 78, stem 36, mandrel 44, and pressing ring 38, forwardly as a single unit. The press 13 is moved forwardly, as shown in FIG. 5, along the longitudinal axis 18 so that the mandrel 44 extends through the bore 56 of the billet 54, through the bore 22 of the inner die 20, through the bore 28 of the outer die 26 and through the bore 32 of the back plate 30. The stem 36 also enters the bore 16, as shown in FIG. 5. The pressing ring 38 is shown in FIG. 5 abutting the rearward end of the billet 54 just prior to applying a forward compressing force to the billet.

A preferred variation of this first step is to actuate cylinder 69 to push the mandrel 44 through the bore 56 of the billet 54 while the billet is supported on a moveable carriage. The cylinder 77 is actuated to move the press 13 toward the container 12, thereby carrying the mandrel 44 and the billet 54 into the bore 16 of the container to the position shown in FIG. 5.

Figure 6:
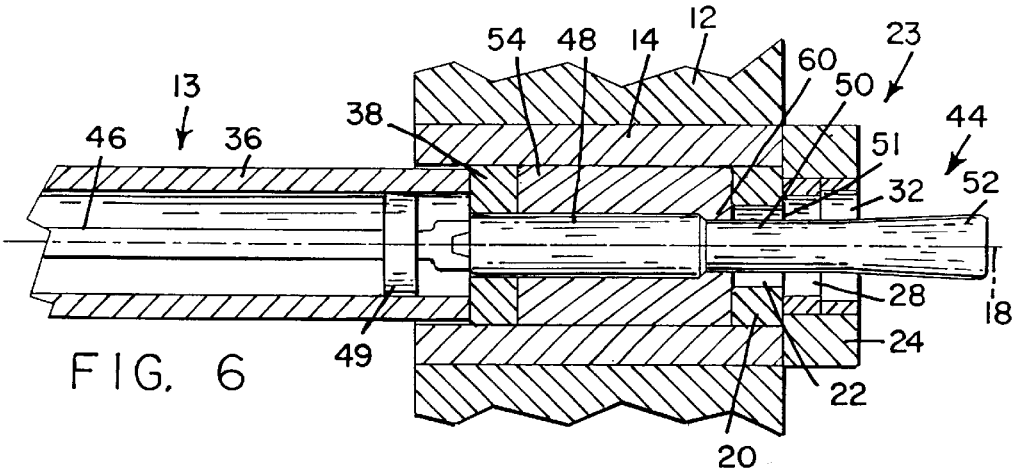

The billet is forced against the rearward end of the inner die 20 by additional forward movement of the press 13. A small forward movement of the press 13 squeezes the billet 54 and forces metal from the billet to completely fill the space between the inner surface of the liner 14 and the billet. Metal at the forward end of the billet 54 is also forced inwardly toward the reduced diameter middle portion 48 of the mandrel 44 as shown in FIG. 6 to form an inward bulge or "upset" 60 of material. At this point, the forward force of the stem 36 has squeezed the billet 54. The billet is thereby reduced slightly in length and the corresponding volume of the billet is diverted to the gap between the liner 14 and the billet 54 and to the gap between the mandrel and the billet to form the "upset" 60. The location of the intersection between the reduced diameter middle portion 50 of the mandrel and rearward portion 48 of the mandrel, relative to the inner die 20, determines the length of the preliminary forward or "pin" section 62 of the pipe, as shown in FIG. 7.

Figure 7:
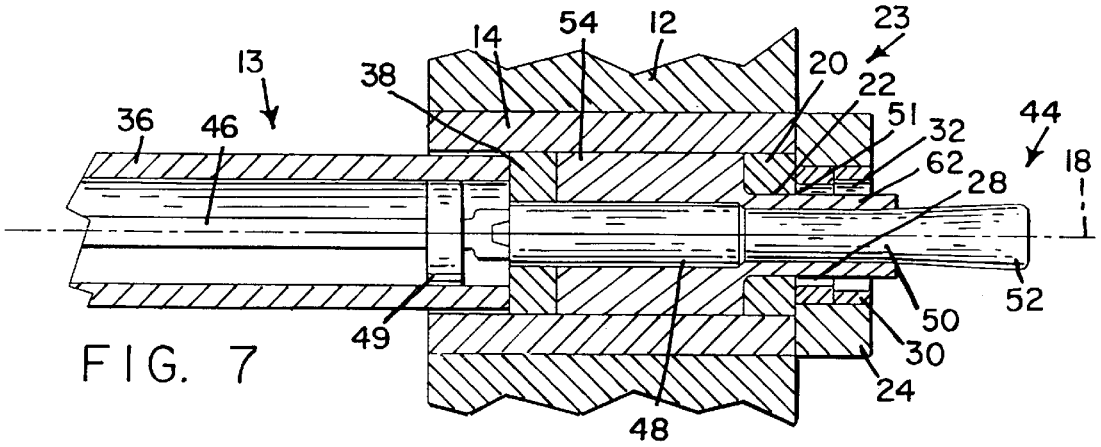
Figure 8:
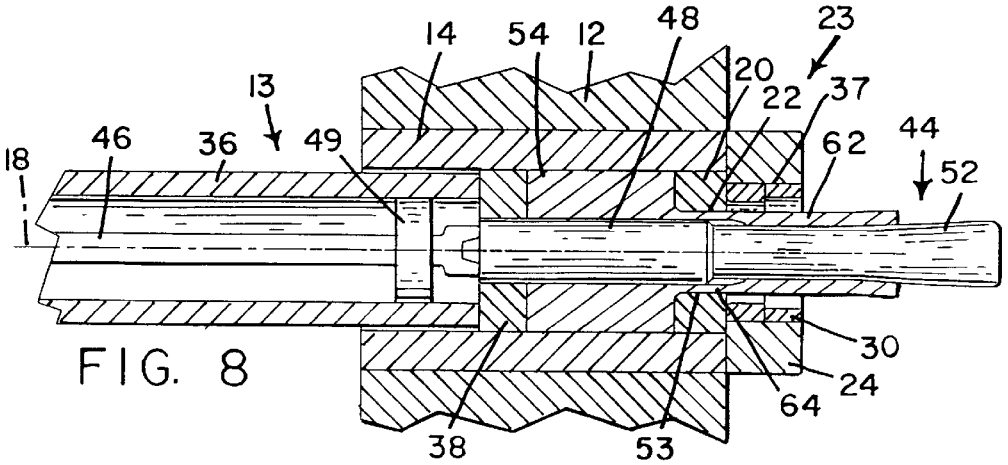

Continuous squeezing of the billet 54 by the forward movement of stem 36 for a first distance forces metal from the billet through a first ring-shaped opening or gap 51 between the inner surface of the inner die 20 and the reduced diameter middle portion 50 of the mandrel to form the cylindrical preliminary forward end section 62 of the pipe, as shown in FIG. 7. Preliminary forward end section 62 will eventually become the "pin" or forward end section of the pipe. The middle section 64 and the forward section 67 of the pipe are formed by moving the press 13 forwardly for a second distance. At this point, the cylindrical large diameter rear portion 48 of the mandrel reaches the rearward portion of the inner die 20. When the rearward portion 48 of the mandrel enters the bore 22 of the inner die 20, as shown in FIG. 8, a second ring shaped opening 53 is formed between the inner surface of the inner die 20 and the rearward portion 50 of the mandrel. The inner diameter of the second ring-shaped opening 53 is greater than the inner diameter of the first opening 51. This also means that the second ring-shaped opening 53 is narrower than the first ring shaped opening 51. Metal from billet 54 is, therefore, forced through the opening or gap 53 by the forward pressure of the stem 36 as a tubular extrusion having a thinner wall thickness. This begins the formation of a cylindrical middle section 64 of the pipe. At the same time, the preliminary forward end section 62 of the pipe reaches the tapered forward portion 52 of the mandrel, as shown in FIG. 8, and begins to expand transversely of the axis 18. Since the cross section of the billet 54 is much larger than the cross section of the finished pipe, the extruded pipe is several times longer than the billet. The length of the extruded pipe is determined by the ratio of the cross sectional area of the billet to the cross sectional area of the pipe (or extrusion ratio). For example, for an extrusion ratio of 12 to 1, for every inch that the press 13 advances, 12 inches of extruded pipe will be formed. This elongation at the point of extrusion causes the extruded pipe to slide over the outside diameter of the mandrel 44, since the mandrel is maintained in a fixed relationship to the housing or stem 36.

Figure 9:
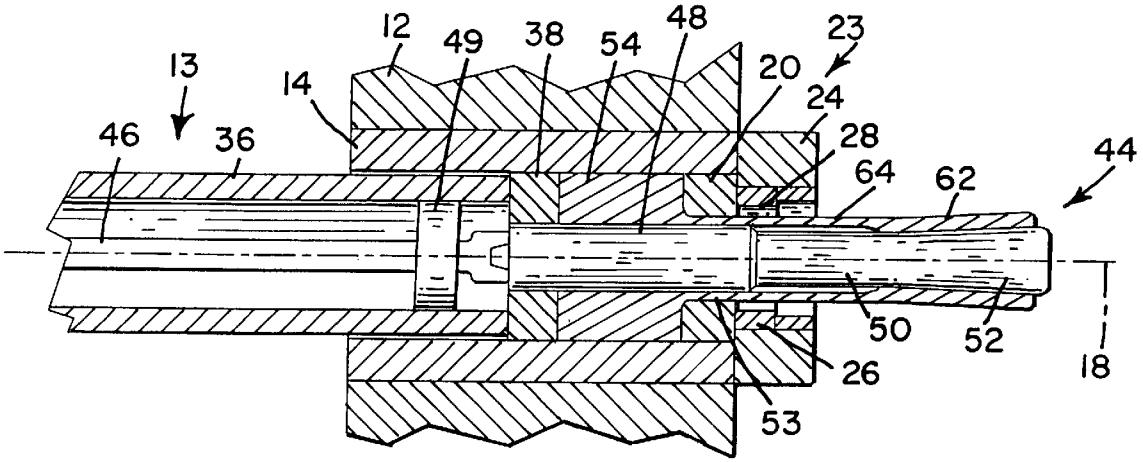

FIG. 9 shows further squeezing of the billet 54 and the lengthening of the middle section 64 of the pipe and continued flaring of the preliminary forward end section 62 of the pipe as it is forced over the tapered forward end portion 52 of the mandrel 44.

Figure 10:
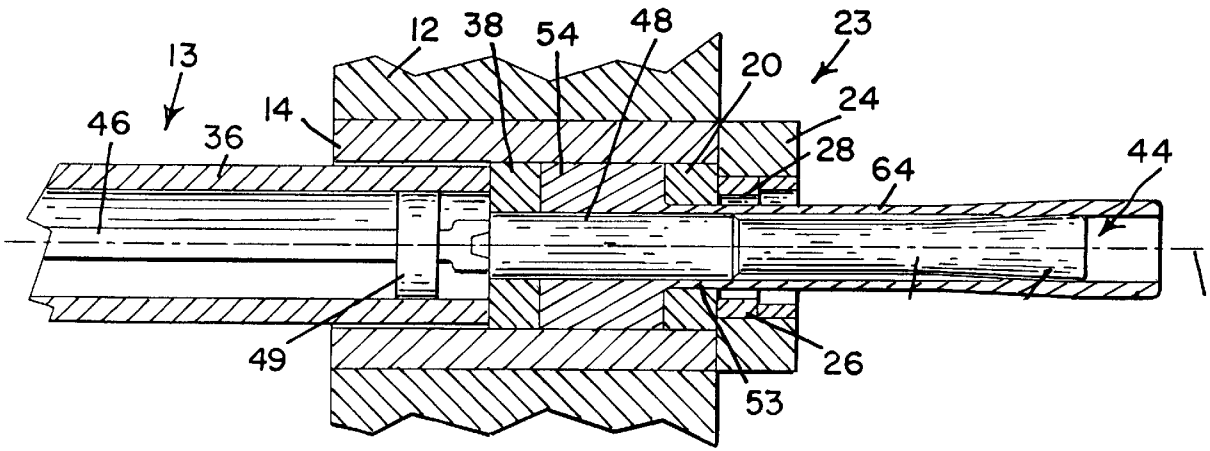
Figure 11:
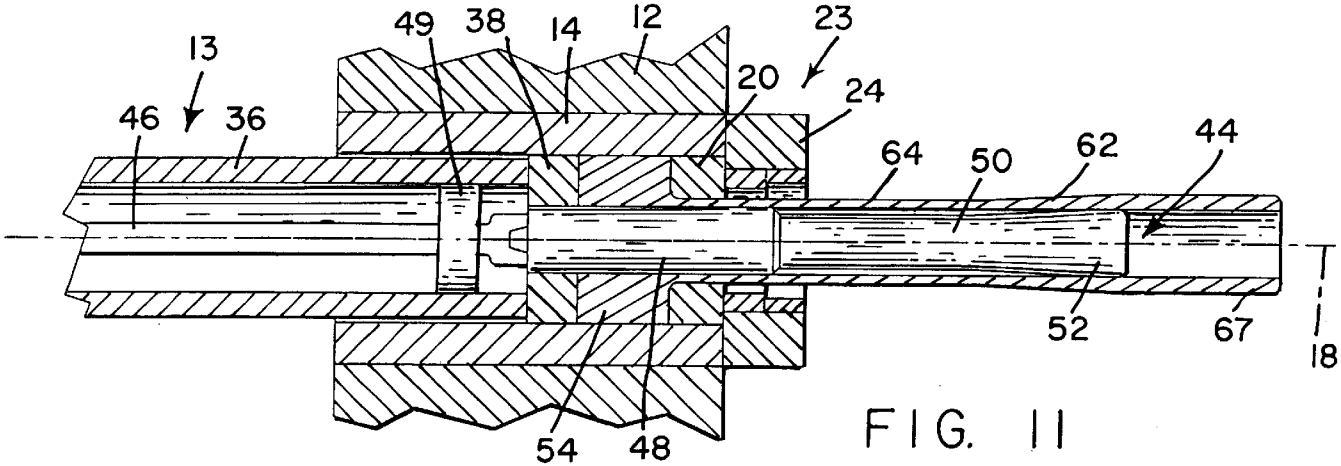

FIGS. 10 and 11 show the completion of the expansion process for the forward end section of the pipe. As the forward end of the preliminary forward end section 62 of the pipe passes the forward end of the tapered forward portion 52 of the mandrel, it becomes cylindrical, as shown in FIG. 10. Also, the inside diameter of the expanded forward end section 62 is the same as the inside diameter of the middle section 64. The preliminary forward end section 62 of the pipe is shown fully expanded in FIG. 11, thereby completing the formation of the forward, or "pin", end section of the pipe and is identified by the reference numeral 67.

Figure 12:
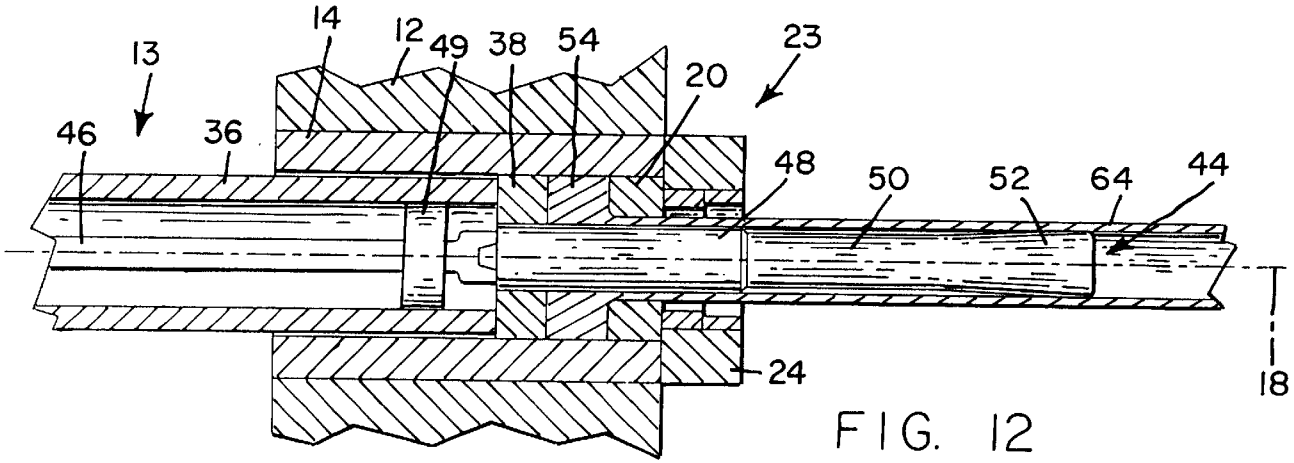
Figure 13:
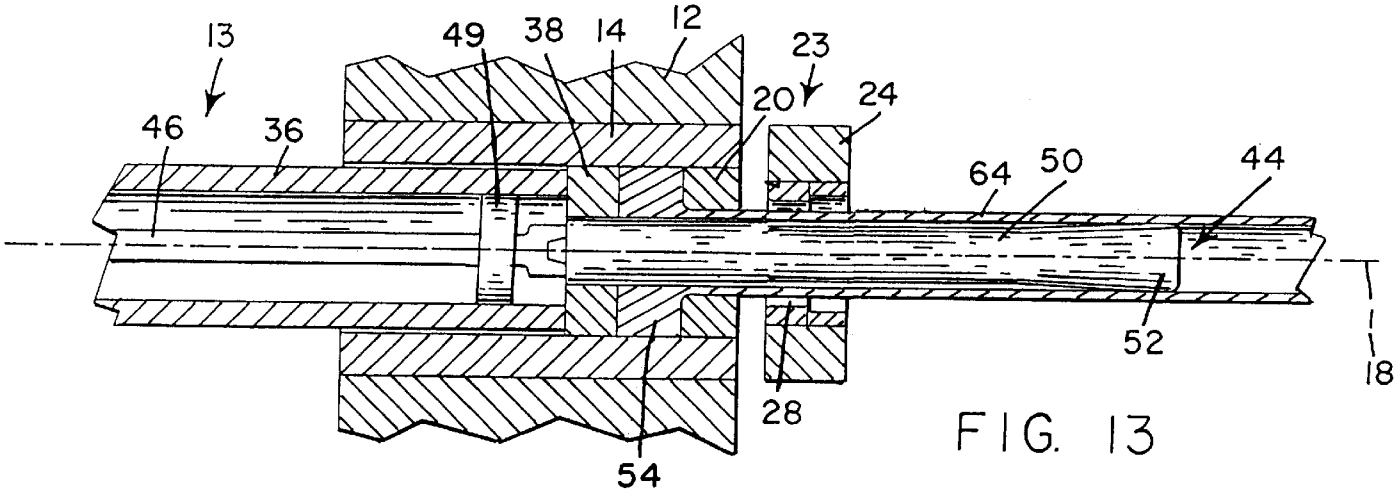
FIGS. 13–18 are operational views showing the formation of the rearward section of the pipe.
Figure 14:
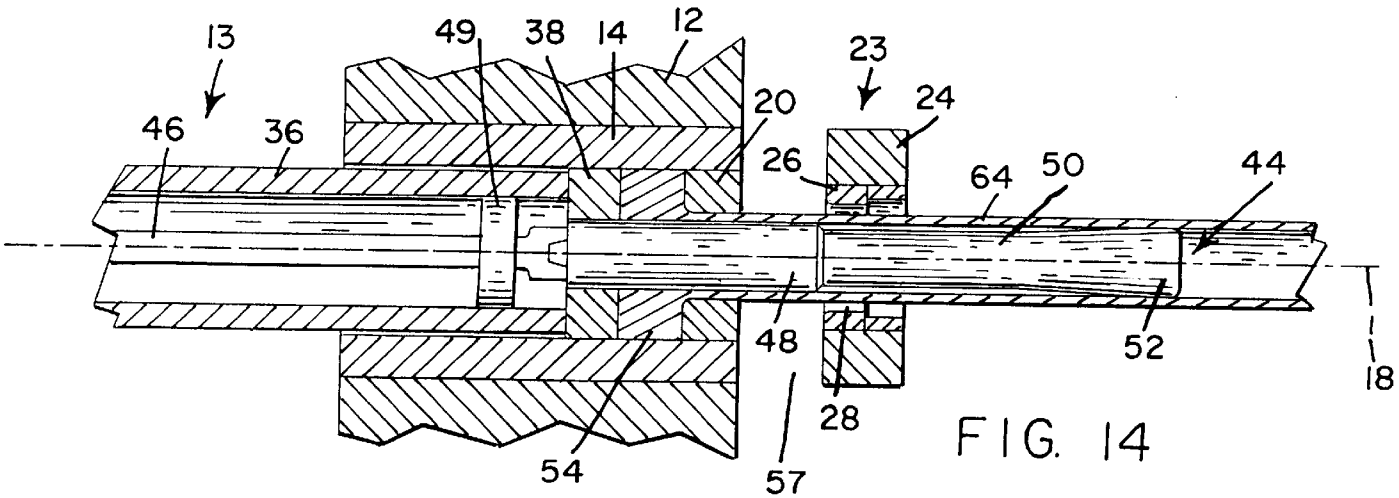
Figure 15:
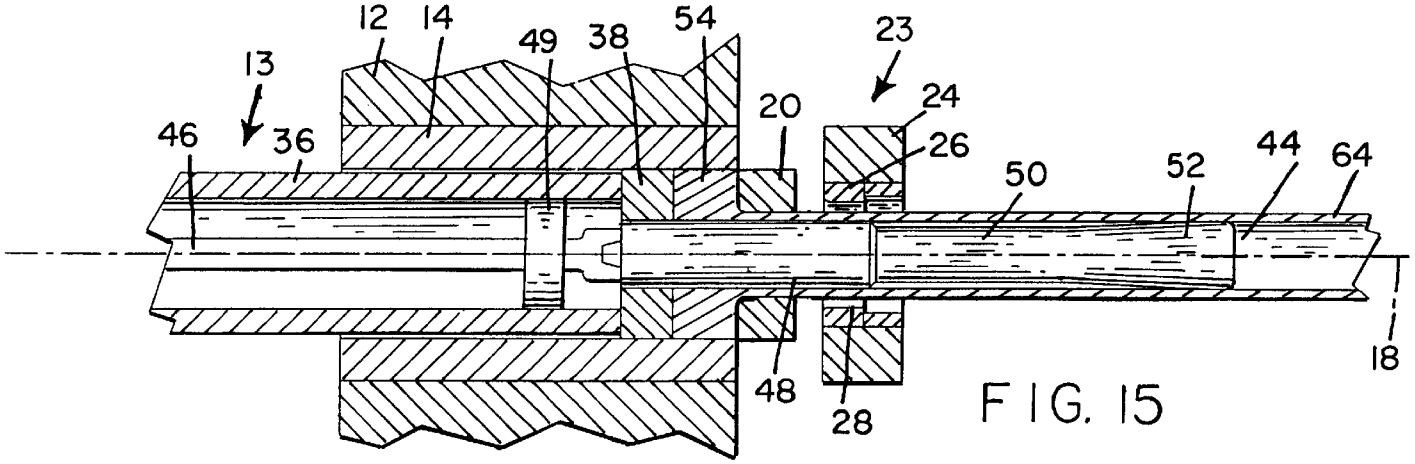
Figure 16:
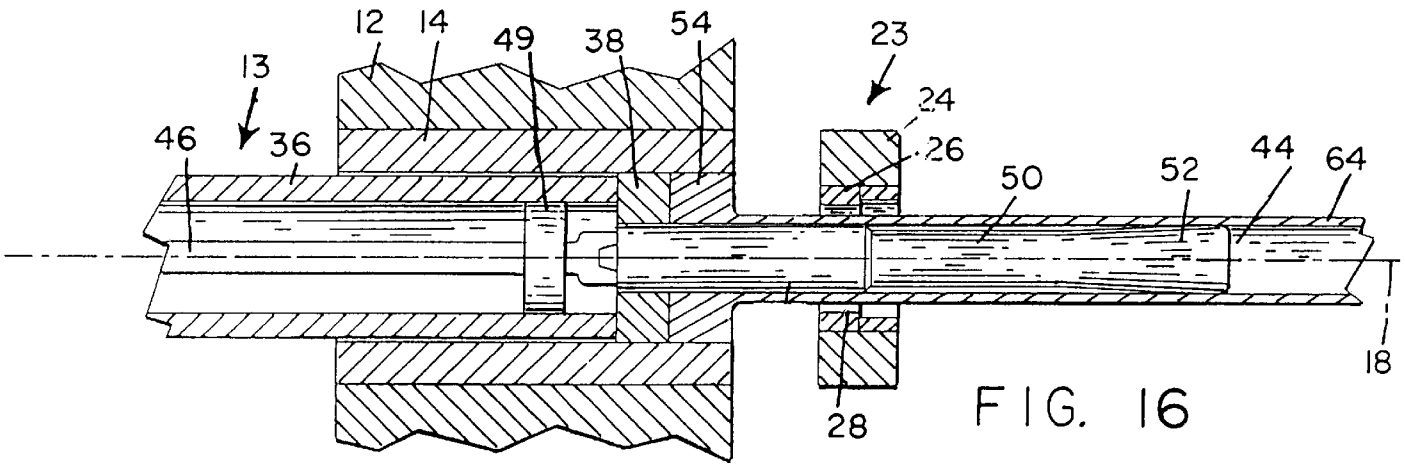
Figure 17:
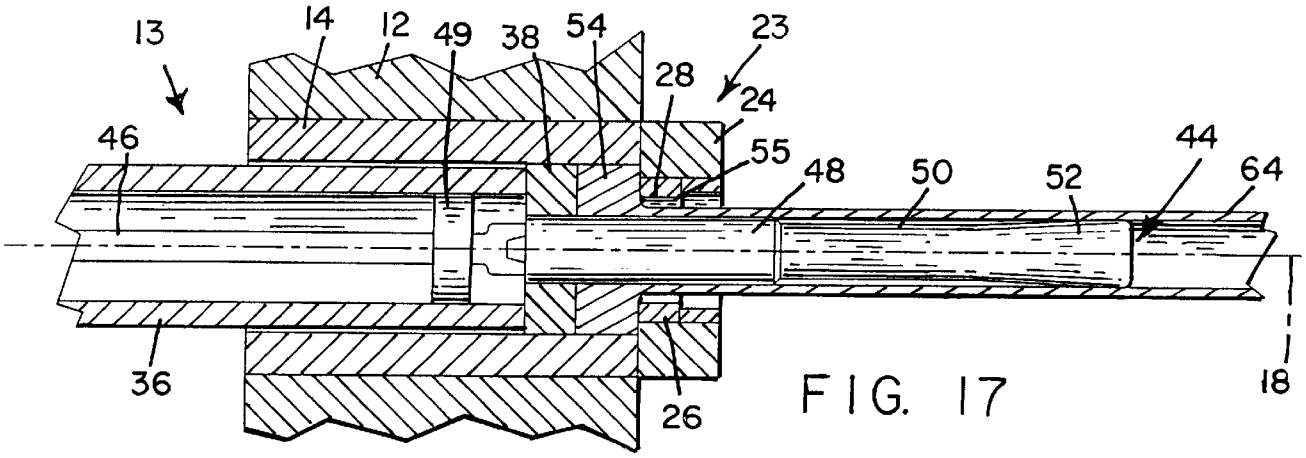

As the stem 36 continues to advance forwardly, the length of the middle section 64 of the pipe gradually lengthens until the required length of pipe has been extruded as shown in FIG. 12. After the middle section 64 of the pipe has been formed, the cylinder 77 is deactivated and the cylinders 81 and 85 are activated simultaneously to move the stem 36 and the container 12 rearwardly. The billet 54 and the partially extruded pipe also move rearwardly with the container 12, as shown in FIG. 13. This creates a small gap between the container 12 and the die holder 24 and eliminates the forward pressure on the die carrier 98. The cylinders 110 are then actuated to remove gates 104 from the chamber 100 and the removable die carrier 98 is moved forwardly to create a gap 57 between the die holder 24 and the container 12, as shown in FIG. 14. Gap 57 is wider than the inner 20. The cylinder 81 is deactivated and the cylinder 77 is again activated to move the stem 36 forwardly. This forces the inner die forwardly out of the container 12 and into the space 57, as shown in FIG. 15. When the inner die 20 clears the front opening 17 of the bore 16, the two halves of the inner die 20 separate and fall away from the middle section 64 of the pipe, as shown in FIG. 16. The housing 98 is moved rearwardly and the stem 36 and container 12 are moved forwardly to the rear opening 103 of the chamber 100 so that the die holder 24 abuts the forward surface of the container 12, as shown in FIG. 17. The cylinders 110 are actuated to return to the gates 104 to the chamber 100 in front of the die carrier 98.

The remaining portion of the billet 54 is used to form the rearward or "box" section of the pipe.

Figure 18:
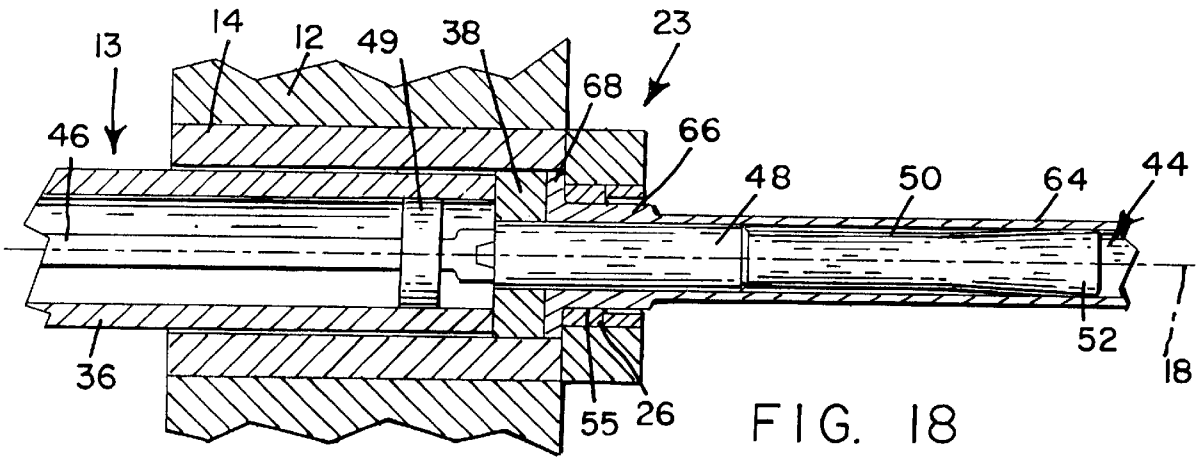

The cylinder 77 is actuated to move the press 13 and the stem 36 forwardly a third distance. The space between the rearward portion 48 of the mandrel and the inner surface of the bore 28 defines a third ring-shaped opening or gap 55. Forward movement of the press 13 for the third distance forces metal from the billet 54 through the third ring-shaped opening or gap 55. The bore 28 of the outer die 26 has a larger diameter than the bore 22 of the inner die 20 so that the thickness of the ring-shaped opening or gap 55 is greater than the thickness of the second ring-shaped opening or gap 53. Therefore, the metal from the billet 54 which is forced through the third opening 55 forms the relatively thicker rearward end section 66 of the pipe, as shown in FIG. 18. The outer diameter of the rearward end section 66 is substantially greater than the outer diameter of the middle section 64 of the pipe. At this point, the extrusion of the pipe is complete. A small unextruded portion of the billet 54 remains after the full desired length of the pipe has been extruded. The unextruded portion is identified by the reference numeral 68 in FIG. 18. The unextruded portion 68 can be removed from the pipe at the extruder by actuating the cylinder 69 to move the mandrel rearwardly out of the extruded pipe and by actuating the cylinder 88 to move the container 12 rearwardly. The rearward movement of the container 12 pushes the unextruded portion 68 of the billet out of bore 16 where it can be sawed from the end of the pipe. Preferably, the extruded pipe, including the unextruded portion 68 is moved a short distance rearward to facilitate removal of the unextruded portion 68. The extruded pipe is removed by actuating the cylinders 110 to move the gates 104 to their inactive positions out of the chamber 100. The die housing 98 is removed from the chamber 100 through the front opening 99. This enables the extruded pipe to be moved from the chamber 100 through the front opening 99. The unextruded portion 68 can be removed from the rearward end of the extruded pipe by any desired means, i.e., shearing, sawing, grinding, torching, laser cutting, etc. The extruded pipe is then removed from the chamber 100. The extruded pipe is a blank pipe form for subsequent finishing. The ends of the pipe are threaded and machined in a conventional manner to form a finished pipe.

Figure 20:
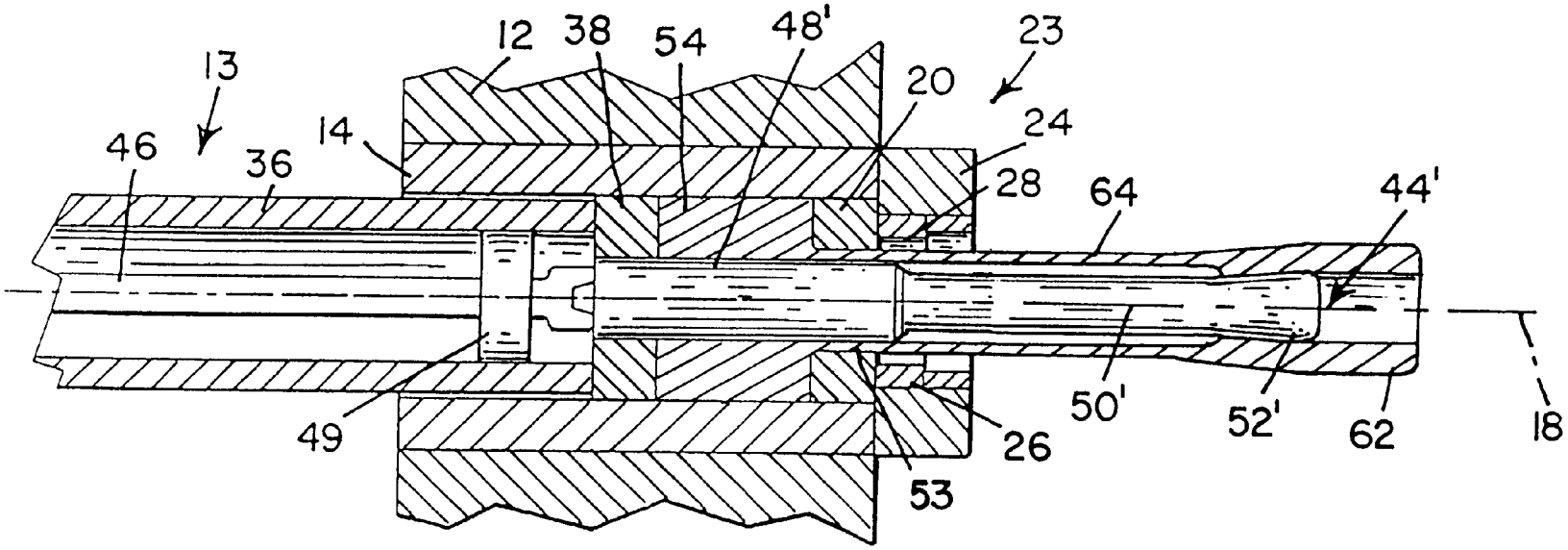
FIG. 20 is a view similar to FIG. 10 and showing a modified mandrel.

Referring to FIG. 20, a modified mandrel, generally indicated by the reference numeral 44', is shown within the container 12 at the expansion step of the forward end section of the pipe. The mandrel 44' has a cylindrical rearward portion 48', a reduced diameter cylindrical portion 50' and a frusto conical portion 52' which tapers outwardly from the reduced diameter middle portion 50' to the forward end of the mandrel. The mandrel 44' is identical to the mandrel 44 with respect to the rearward and middle portions of the mandrel. However, the mandrel 44' differs from the mandrel 44 with respect to the frusto conical forward portion of the mandrel. The outer diameter of the extreme forward end of the mandrel 44' is greater than the outer diameter of the middle portion 50' and less than the outer diameter of the rearward portion 48'. As the forward end of the preliminary forward end section 62 of the pipe passes the forward end of the tapered portion 52' of the mandrel 44', section 62 becomes cylindrical, as shown in FIG. 20. However, the inside diameter of the expanded forward end section 62 is less than the inside diameter of the middle section 64 of the pipe.

Referring to FIGS. 21–32, there is shown a modified mandrel and die arrangement, generally indicated by the reference numeral 130.

The modification shown in FIGS. 21–32 differs from that of the embodiment shown in FIGS. 1–20 in that the "upset" at the rear end of the pipe is relatively smaller. This relatively small "upset" section of the pipe can be welded to a refabricated box end rather than forming the "box end" as an integral part of the extrusion.

The modified embodiment 130 has two advantages. First, the modified embodiment can be employed in some situations where extrusion press capacity or the geometry of the tooling makes the box end forming impossible. Second, the modified embodiment 130 works as well as the embodiment in FIGS. 1–20 for applications where large diameter box ends are not required, such as the case where pipes are welded from end to end without threaded connectors. Also, embodiment 130 negates the need for the split die and the additional step of stopping to remove the split die during extrusion. In some extrusion presses, the ability to utilize a split die is difficult or impractical due to the basic design of the equipment. In addition, welding the box end to a rearward upset section maintains the advantage of thinner wall sections in the center portion of the pipe, which is fundamental benefit of doubled ended upset pipe (weight and material savings).

Figure 21:
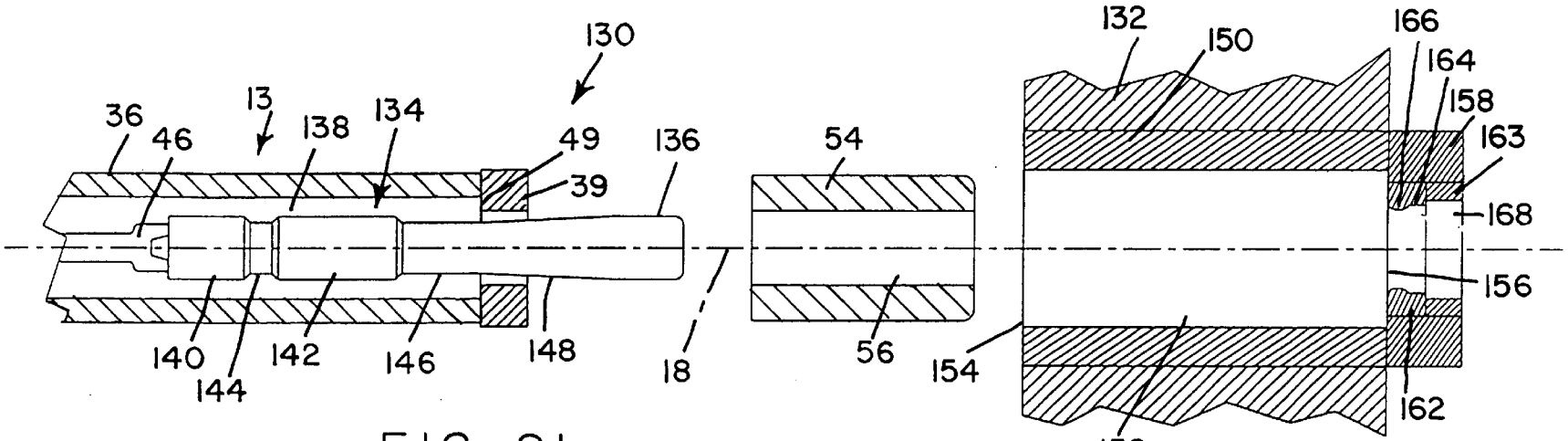
FIG. 21 is a longitudinal cross-sectional view of the primary functional components of a modified extruding apparatus for forming a double ended upset pipe.

FIG. 21 shows the modified embodiment 130 prior to insertion of the billet 54 into the container 132. The modified mandrel is generally indicated by the reference numeral 134, see FIG. 22.

Figure 29:
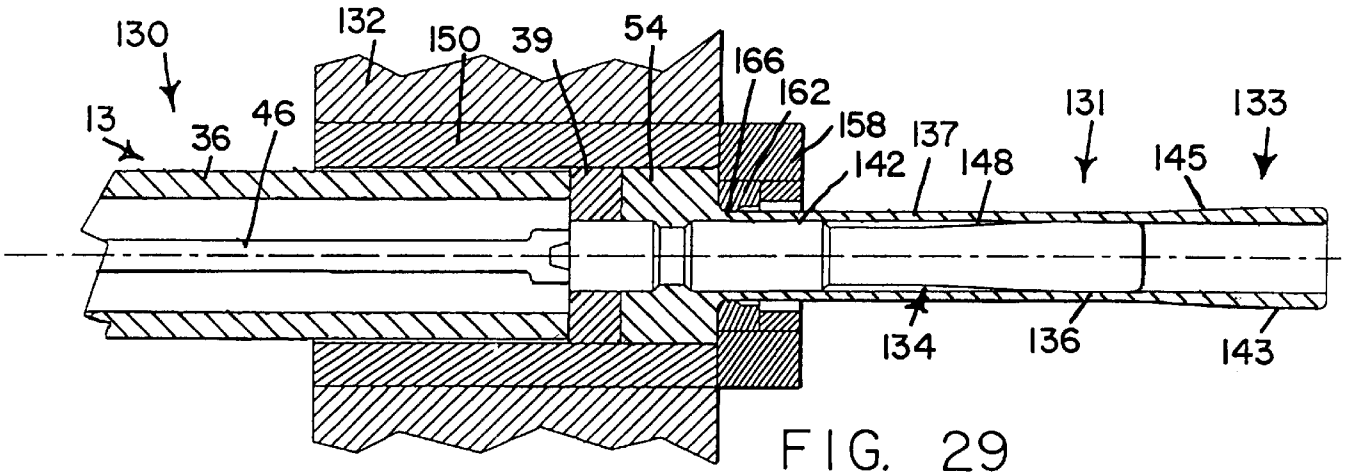
Figure 32:
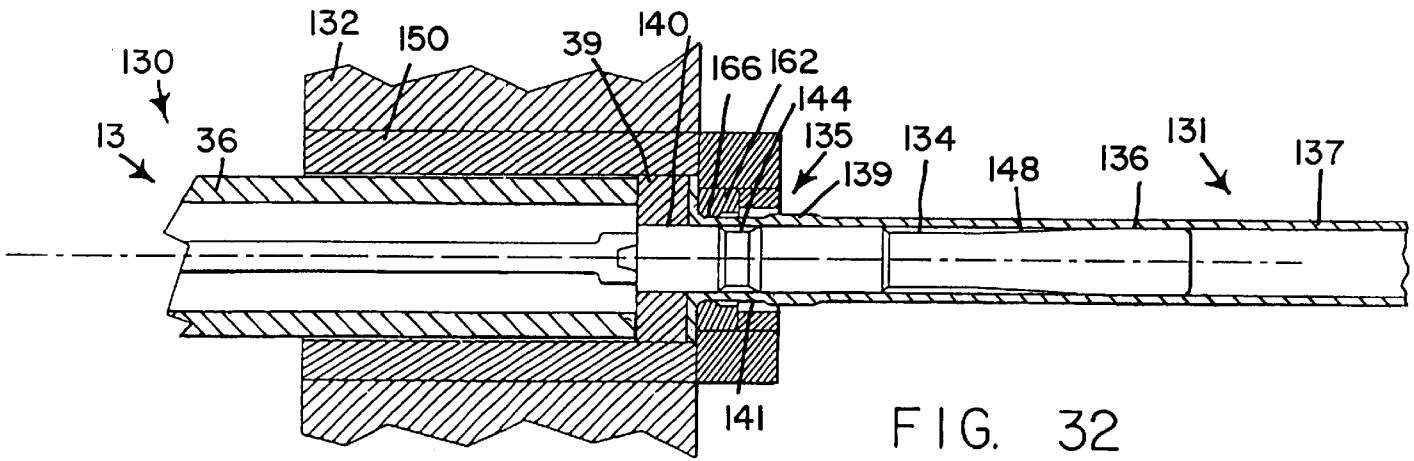

Referring to FIGS. 29 and 32, the pipe to be produced by the modified embodiment 130 is generally indicated by the reference numeral 131. Pipe 131 comprises a forward or first end section, generally indicated by the reference numeral 133, a rearward or second end section, generally indicated by the reference numeral 135, and a middle section 137 between the first end section 133 and the second end section 135. Pipe 131 has a uniform inner diameter of a first dimension. The middle section 137 has an outer diameter of a second dimension. The first end section 133 has an outer portion 143 and an inner portion 145. Outer portion 143 has an outer diameter of a third dimension which is greater than the second dimension. The outer surface of inner portion 145 tapers from the second dimension of the middle portion 137 to the third dimension of the outer portion 145. The second end section 133 has an inner portion 139 and an outer or tail end portion 141.

The inner portion 139 of the second section 135 has an outer diameter of the third dimension. The outer or tail end portion 141 has an outer diameter of the second dimension and is cut off after extrusion of the pipe.

Figure 22:
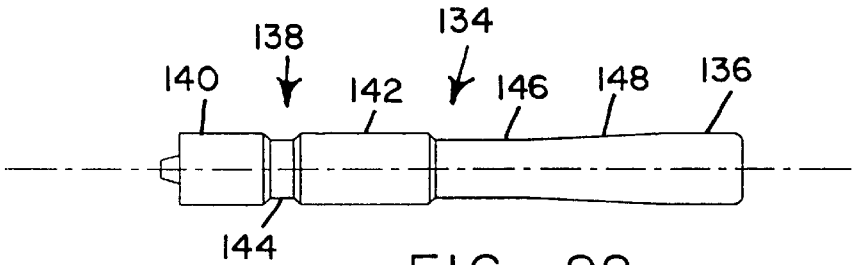
FIG. 22 is a side elevational view of the mandrel portion of the modified extruding apparatus.

Referring particularly to FIGS. 21 and 22, the mandrel 134 comprises a cylindrical forward section 136, a rearward section, generally indicated by the reference numeral 138, a central section 146, and an expanding section 148. The forward section 136 has an outer diameter of the first dimension. The rearward section 138 has a cylindrical forward portion 142, a cylindrical rearward portion 140, and an intermediate portion 144 between the portions 140 and 142. Each of the portions 140 and 142 has an outer diameter of the first dimension. The intermediate portion 144 has an outer diameter of a fourth dimension which is smaller than the first dimension. The central section 146 has an outer diameter of the fourth dimension. The outer surface of the expanding section 148, which has a frusto-conical shape, extends forwardly from the fourth dimension of the central section 146 to the first dimension of the forward section 136.

Container or housing 132 contains a cylindrical tube or liner 150 having a circular bore 152 which is coaxial with longitudinal axis 18. The bore 152 has a circular rear opening 154 and a circular front opening 156. A die holder 158 is secured in a fixed position at the front opening 156. Die holder 158 has a bore 160 which contains a die 162 and a backplate 163. Die 162 has a circular 166 at the opening 156 and a circular relief bore or counterbore 166 between the bore 166 and the backplate 163. Backplate 163 has a circular bore 16 which is larger than bore 166.

The bore 166 is a sizing bore which has an inner diameter equal to the outer diameter of the middle section 133 of the pipe (said second dimension). The forward counterbore 164 is a relief bore to provide clearance for extruded material that this "upset" during certain phases of the extrusion process.

Figure 23:
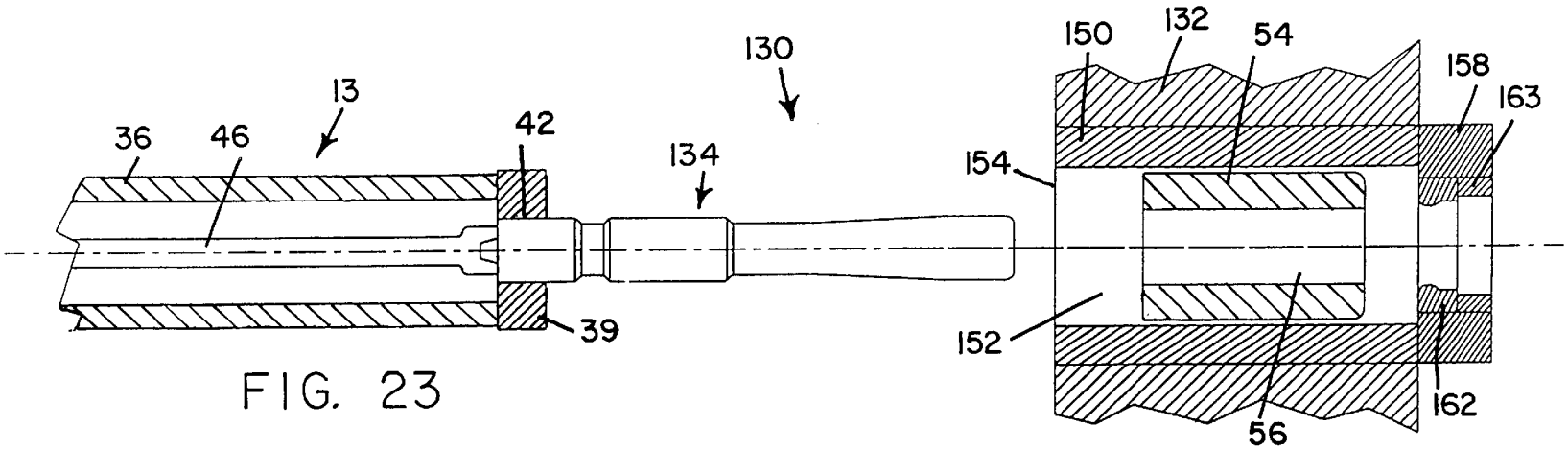
FIGS. 23–29 are operational views illustrating the formation of the forward and middle sections of the pipe.

Referring to FIG. 23, the billet 54 is shown within the bore container 132. The billet is machined to size, such that the outside diameter (or O.D.) of the billet has a specified amount of clearance to the inside diameter (or I.D.) of the liner. Similarly, the I.D. of the billet has a specified clearance to the O.D. of the mandrel. The stem 36 of the press 13 moves and applies the force of the press to the billet 54 . The mandrel 134 can be retracted into the stem to provide clearance for loading the billet into the press. Once the billet has been loaded into the press, the mandrel 134 extends forward until the back end of the mandrel is flush to the front face of the stem. At this time, the mandrel is locked in place, and the stem 36, mandrel 134 and pressing ring 38 move as one unit.

Figure 24:
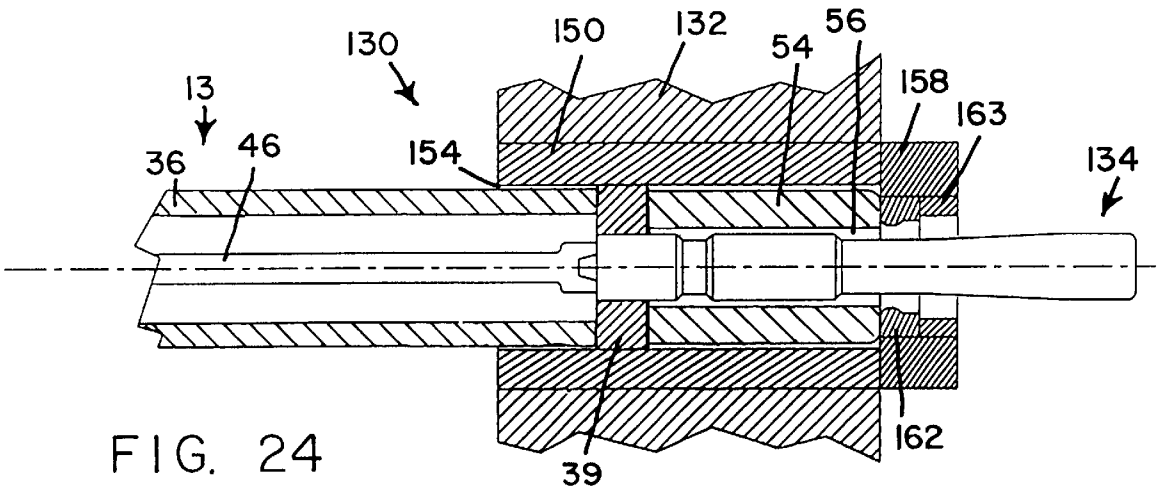

FIG. 24 shows the billet 34 within the bore 152 of the container 132 with the stem 36 and mandrel 134 extended just prior to applying force to it.

Figure 25:
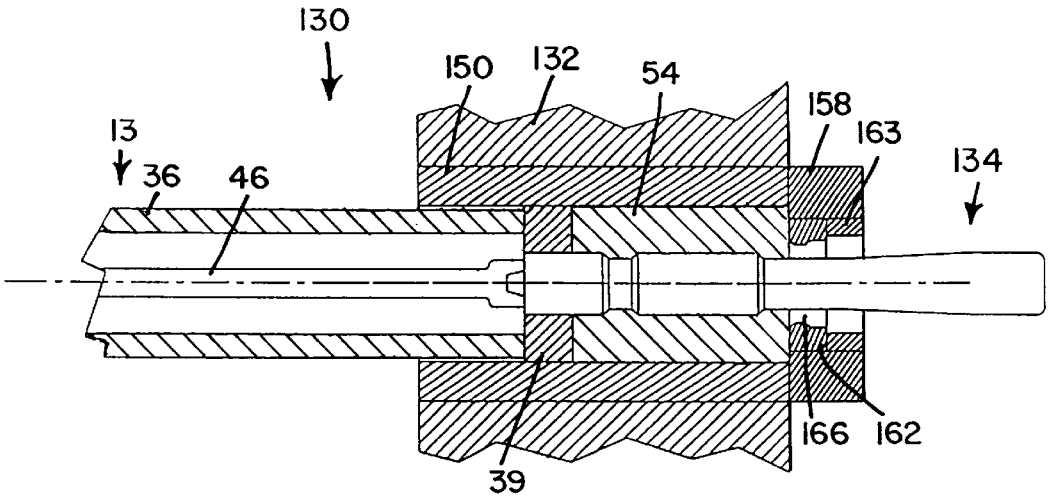

FIG. 25 shows the billet 54 in the upset stage. At this point, the forward force of the stem has squeezed the billet. As a result, the billet 54 reduces in length and the corresponding volume of the billet is diverted to the gaps between the liner 150 and the O.D. of the billet and the mandrel and the I.D. of the billet. The billet 54 has also upset down on both stepped sections 144 and 146 of the mandrel. The location of the forward step is designed to facilitate the length of the forward upset section. The location of the rearward step (central section 146) is to facilitate the formation of the rearward upset section of the pipe. During extrusion, the material in the stepped sections 144 and 146 of the mandrel will form the upset sections of the pipe.

Figure 26:
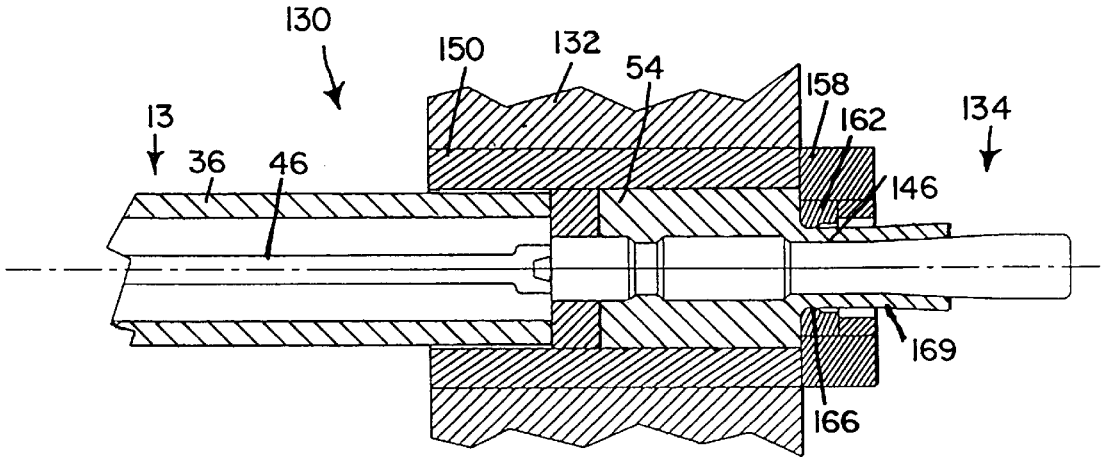

FIG. 26 shows the beginning of the extrusion. As force is applied by the stem, the billet 54 is forced through the gap created by the bore 166 of the die 162 and the central section 146 of the mandrel. Because of the step in the mandrel formed by section 146, the initial part of the extrusion indicated by reference numeral 169, has a thicker wall.

Figure 27:
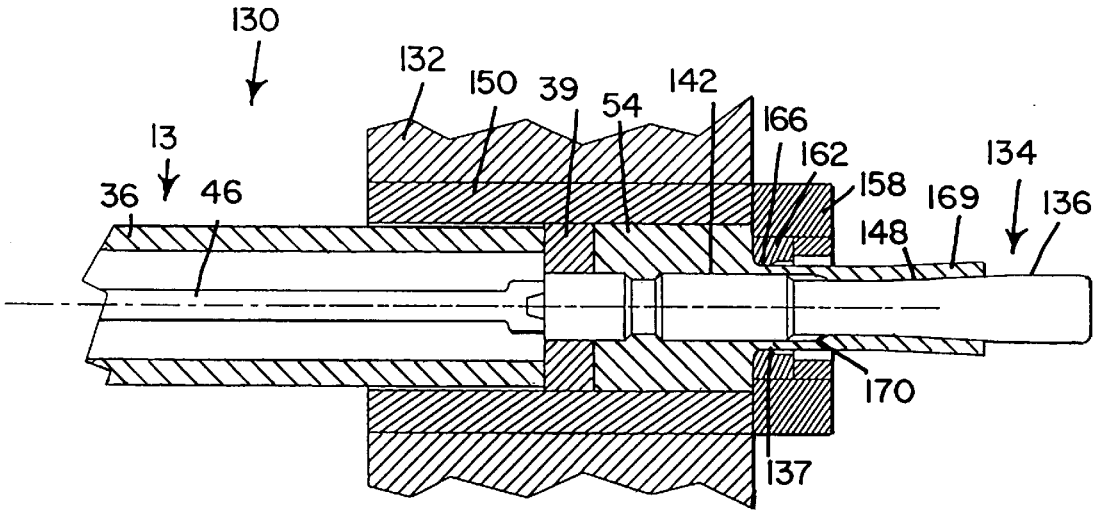

FIG. 27 shows the extrusion with the forward upset section through the die 162 and partially expanded over the taper of the expanding section 148 at the front end of the mandrel 134. As the billet 54 and mandrel advance, the forward portion 142 of the mandrel penetrates the bore 166 of the die 162. At this point, the gap between the die and mandrel is reduced, and the wall thickness of the extrusion decreases. Notice that a step 170 is created on the I.D. of the extrusion as the thin walled middle section 132 of the pipe slides over the mandrel. Since the cross section of the billet is much larger than the cross section of the pipes, the resulting extrusion is many times longer than the original billet length. The length of extrusion made is in direct proportion to the ratio of the cross sectional area of the billet to the cross sectional area of the pipe (or extrusion ratio). For example, if the extrusion ratio is 12 to 1, for every inch that the stern advances, 12" of extrusion will be formed. This elongation at the point of extrusion causes the extrusion to slide over the mandrel, since the mandrel is fixed in relation to the stem.

Figure 28:
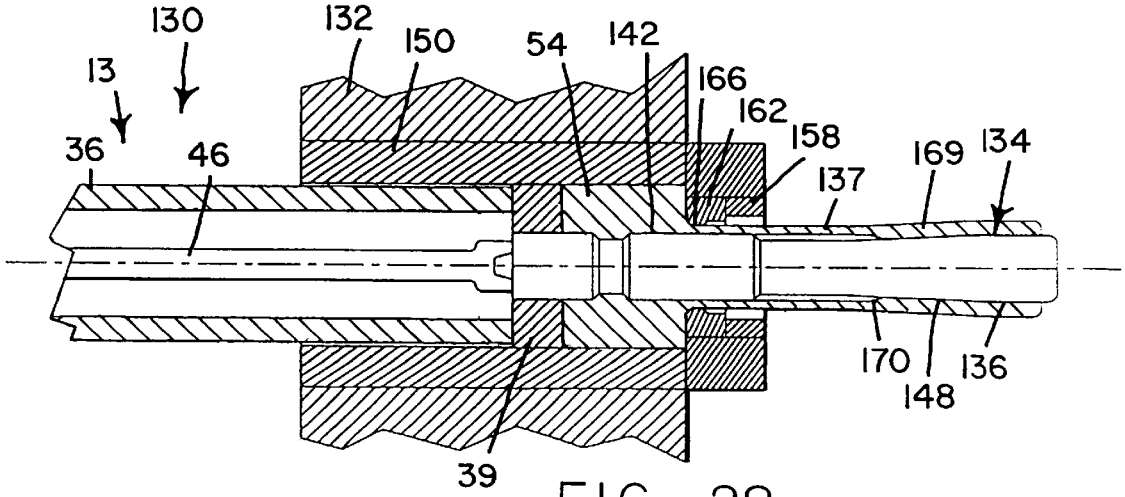

FIG. 28 shows the front end of the extrusion being expanded over the tapered section 148 of the mandrel 134 as it advances forward.

FIG. 29 shows the front end of the extrusion fully formed and the middle section 137 of the pipe section being extruded.

Figure 30:
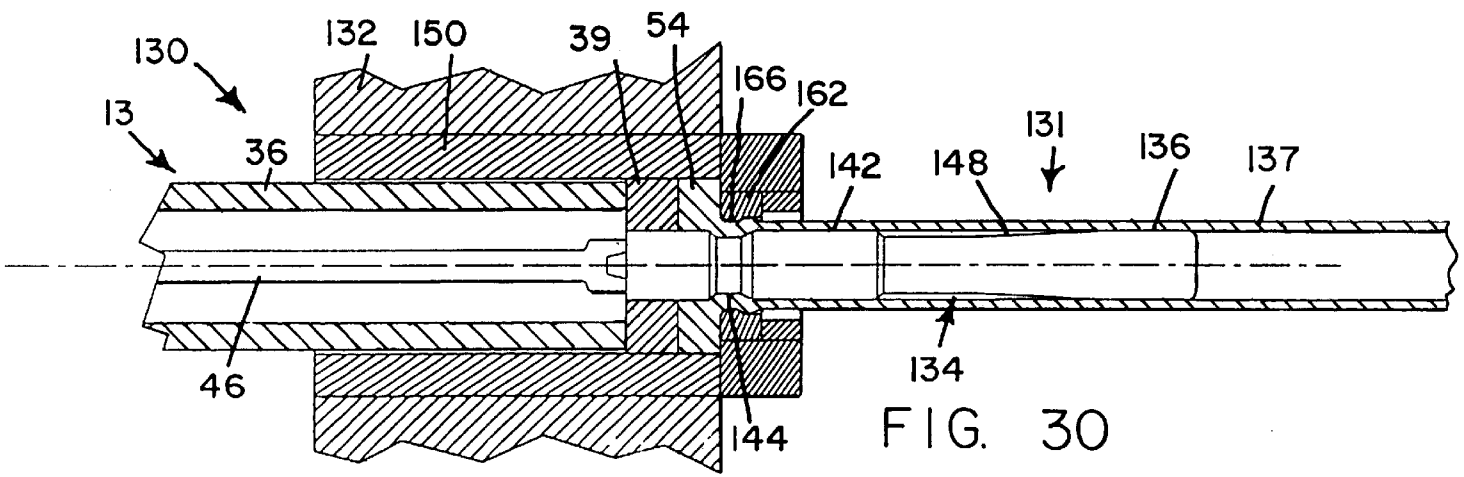
FIGS. 30–32 are operational views illustrating the formation of the rearward section the pipe.

FIG. 30 shows the beginning of the rearward upset or second end section 135 of the pipe being extruded in the gap between the die 112 and the intermediate portion 144 of the mandrel 134 and starting to expand over the forward portion 142 mandrel.

Figure 31:
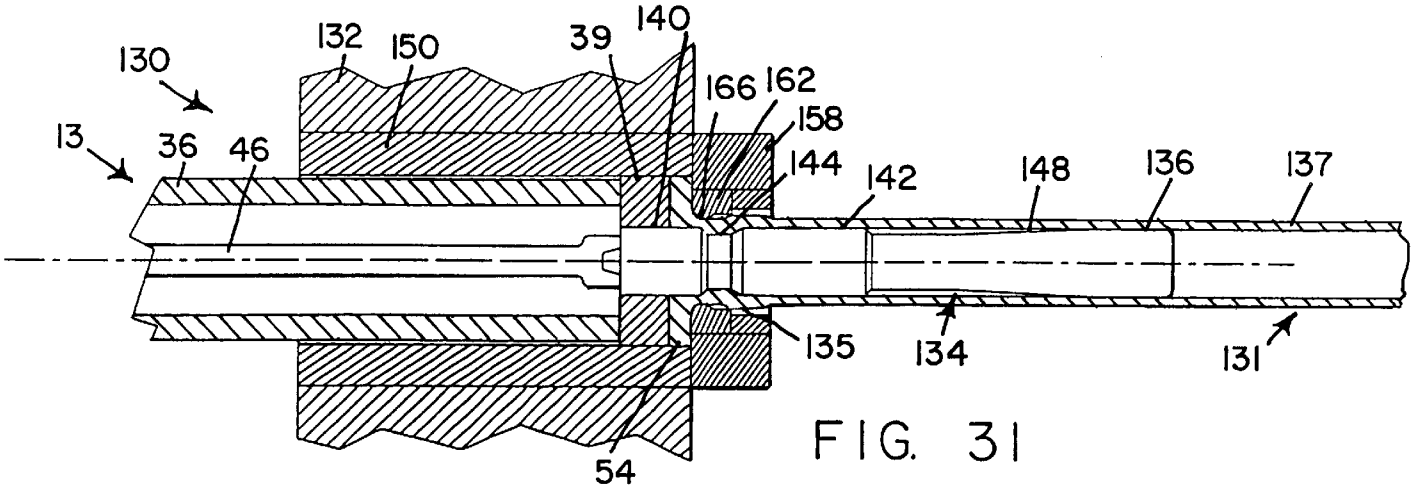

FIG. 31 shows the rearward upset or, second end section 135 fully extruded and partially expanded.

FIG. 32 shows the rearward upset section fully expanded. It is important to note that a length of extrusion tail end with a thin wall section must be made behind the rearward upset section or outer portion 141 in order to allow for the mandrel to be retracted out of the extrusion. FIG. 32 shows the extrusion process completed. At this point, the tail end section 141 and unextruded portion of the billet are removed from the extrusion by sawing, flame cutting or shearing.

The invention having been thus described, what is claimed as new and desired to secure by Letters Patent is:

1. An apparatus for extruding a metal pipe having a uniform inner diameter of a first dimension, said pipe having a first end section, a second end section and a middle section between said first end section and said second end section, said middle section having an outer diameter of a second dimension, said first end section having an outer diameter of a third dimension which is greater than said second dimension, said second end section having an inner portion which has an outer diameter of said third dimension, and an outer portion which has an outer diameter of said second dimension, said apparatus comprising:

(a) a machine frame;

(b) a container supported on the machine frame, said container having a central longitudinal axis and a longitudinal cylindrical first bore coaxial with said central longitudinal axis for receiving a cylindrical metal billet having a longitudinal cylindrical bore, said container having a rear opening to said first bore for receiving said billet and a front opening to said first bore;

(c) a cylindrical die at said at said front opening, said die having a cylindrical second bore coaxial with said first bore and having a diameter which is greater than said second dimension and a third bore between said first bore and said second bore and having a diameter of said second dimension; and (e) a press located rearward of said container and movable along said central longitudinal axis toward and away from said container, said press having a circular forward pressing surface facing the rear opening of said container and a mandrel extending forwardly from said pressing surface toward said rear opening, said pressing surface and said mandrel being coaxial with said first bore, said pressing surface having substantially the same outer diameter as the inner diameter of said first bore with sufficient clearance to enable said pressing surface to move longitudinally within said first bore, said mandrel having a cylindrical forward section having an outer diameter equal to said first dimension and a rearward section having a rearward portion, a forward portion and an intermediate portion between said forward portion and said rearward portion, each of said forward portion and said rearward portion having an outer diameter of said first dimension, said intermediate portion having an outer diameter of a fourth dimension which is smaller than said first dimension, said mandrel having a central section between said rearward section and said forward section, said central section having an outer diameter of said fourth dimension, said mandrel having a frusto conical expanding section extending from said central section where said expanding section has an outer diameter of said fourth dimension to said forward section where said expanding section has an outer diameter of said second dimension.

2. An apparatus for extruding a metal pipe having a uniform inner diameter of a first dimension, said pipe having a first end section, a second end section and a middle section between said first end section and said second end section, said middle section having an outer diameter of a second dimension, each of said first end section and said second end section having an outer diameter of a third dimension which is greater than said second dimension, said apparatus comprising:

(a) a machine frame;

(b) a container supported on the machine frame, said container having a central longitudinal axis and a longitudinal cylindrical first bore coaxial with said central longitudinal axis for receiving a cylindrical metal billet having a longitudinal cylindrical bore, said container having a rear opening to said first bore for receiving said billet and a front opening to said first bore;

(c) a cylindrical die at said at said front opening, said die having a cylindrical second bore coaxial with said first bore and having a diameter of said second dimension; and (e) a press located rearward of said container and movable along said central longitudinal axis toward and away from said container, said press having a circular forward pressing surface facing the rear opening of said container and a mandrel extending forwardly from said pressing surface toward said rear opening, said pressing surface and said mandrel being coaxial with said first bore, said pressing surface having substantially the same outer diameter as the inner diameter of said first bore with sufficient clearance to enable said pressing surface to move longitudinally within said first bore, said mandrel having a cylindrical forward section having an outer diameter equal to said first dimension, and a rearward section having a rearward portion, a forward portion and an intermediate portion between said forward portion and said rearward portion, each of said forward portion and said rearward portion having an outer diameter of said first dimension, said intermediate portion having an outer diameter of a fourth dimension which is smaller than said first dimension, said mandrel having a central section between said rearward section and said forward section, said central section having an outer diameter of said fourth dimension, said mandrel having a frusto conical expanding section extending from said central section where said expanding section has an outer diameter of said fourth dimension to said forward section where said expanding section has an outer diameter of said second dimension.

3. A mandrel for use in a metal extruding machine for extruding a metal pipe having a uniform inner diameter of a first dimension, said pipe having a first end section, a second end section and a middle section between said first end section and said second end section, said middle section having an outer diameter of a second dimension, each of said first end section and said second end section having an outer diameter of a third dimension which is greater than said second dimension, said mandrel comprising:

(a) a cylindrical forward section having an outer diameter equal to said first dimension;

(b) a rearward section having a rearward portion, a forward portion and an intermediate portion between said forward portion and said rearward portion, each of said forward portion and said rearward portion having an outer diameter of said first dimension, said intermediate portion having an outer diameter of a fourth dimension which is smaller than said first dimension;

(c) a central section between said rearward section and said forward section, said central section having an outer diameter of said fourth dimension;

(d) a frusto conical expanding section extending from said central section where said expanding section has an outer diameter of said fourth dimension to said forward section where said expanding section has an outer diameter of said second dimension.

4. A method of extruding a metal pipe having a uniform inner diameter of a first dimension, said pipe having a first end section, a second end section and a middle section between said first end section and said second end section, said middle section having an outer diameter of a second dimension, each of said first end section and said second end section having an outer diameter of a third dimension which is greater than said second dimension, said method comprising:

(a) positioning a cylindrical metal billet having a cylindrical longitudinal bore within a cylindrical first bore of a container by inserting said billet through a rear opening to said first bore, said first bore having a central longitudinal axis, said container having a front opening to said first bore and a die at said front opening, said die having a cylindrical second bore coaxial with said first bore and having a diameter of said second dimension;

(b) positioning a press along said central longitudinal axis, said press having a circular forward pressing surface facing said container and a mandrel extending forwardly from said pressing surface toward said container, said pressing surface and said mandrel being coaxial with said first bore, said pressing surface having substantially the same outer diameter as the inner diameter of said first bore with sufficient clearance to enable said pressing surface to move longitudinally within said first bore, said mandrel having a cylindrical forward section having an outer diameter equal to said first dimension, a rearward section having a rearward portion, a forward portion and an intermediate portion between said forward portion and said rearward portion, each of said forward portion and said rearward portion having an outer diameter of said first dimension, said intermediate portion having an outer diameter of a fourth dimension which is smaller than said first dimension, said mandrel having a central section between said rearward section and said forward section, said central section having an outer diameter of said fourth dimension, said mandrel having a frusto conical expanding section extending from said central section where said expanding section has an outer diameter of said fourth dimension to said forward section where said expanding has an outer diameter of said second dimension;

(c) moving said press forwardly along said central longitudinal axis so that said mandrel extends through the bore of said billet and said central section lies within said second bore to form a first ring-shaped opening and the juncture of said central section and said forward portion is spaced rearward of said die when said forward pressing surface first engages said billet to push said billet against said die at said second bore;

(d) moving said press forwardly a first distance along said central longitudinal axis for forcing metal from said billet through said first ring-shaped opening to extrude a preliminary first end section of pipe having an outer diameter of said second dimension;

(e) moving said press forwardly along said central longitudinal axis a second distance with the forward portion of said rearward section within said second bore to form a second ring-shaped opening for forcing metal from said billet through said second ring-shaped opening to extrude the middle section of said pipe having an outer diameter of said second dimension and an inner diameter of said first dimension and causing said preliminary first end section of pipe to pass over the expanding section and forward section of said mandrel during forward movement of said press for said second distance so that the preliminary forward end section of said pipe is expanded transversely of said central longitudinal axis to an inner diameter of said first dimension and an outer of said third dimension;

(f) moving said press forwardly along said central longitudinal axis for a third distance with the intermediate portion of said rearward section within said second bore to form a third ring-shaped opening for forcing metal from said billet through said third ring-shaped opening to extrude a preliminary second end section of said pipe while simultaneously causing said preliminary end section to pass over said forward portion so that said preliminary second section is expanded transversely of said central longitudinal axis to an inner diameter of said first dimension and an outer diameter of said third dimension;

(g) moving said press forwardly along said central longitudinal axis for a fourth distance with said rearward portion within said second bore to form said second ring-shaped opening for a second time for forcing metal from said billet through said second ring-shaped opening to form a tail end section of said pipe having the same inner and outer diameters of the middle section of said pipe while simultaneously forcing said preliminary second end section of said pipe over the forward section of said mandrel to complete the formation of the second section of said pipe;

(h) removing said extruded pipe from said mandrel; and (i) removing said tail end from said pipe.

5. A method of extruding a metal pipe having a uniform inner diameter of a first dimension, said pipe having a first end section, a second end section and a middle section between said first end section and said second end section, said middle section having an outer diameter of a second dimension, each of said first end section and said second end section having an outer diameter of a third dimension which is greater than said second dimension, said method comprising:

(a) positioning a cylindrical metal billet having a cylindrical longitudinal bore within a cylindrical first bore of a container by inserting said billet through a rear opening to said first bore, said first bore having a central longitudinal axis, said container having a front opening to said first bore and a die at said front opening, said die having a cylindrical second bore coaxial with said first bore and having a diameter of said which is greater than said second dimension and a third bore between said first bore and said second bore and having a diameter of said second dimension;

(b) positioning a press along said central longitudinal axis, said press having a circular forward pressing surface facing said container and a mandrel extending forwardly from said pressing surface toward said container, said pressing surface and said mandrel being coaxial with said first bore, said pressing surface having substantially the same outer diameter as the inner diameter of said first bore with sufficient clearance to enable said pressing surface to move longitudinally within said first bore, said mandrel having a cylindrical forward section having an outer diameter equal to said first dimension, a rearward section having a rearward portion, a forward portion and an intermediate portion between said forward portion and said rearward portion, each of said forward portion and said rearward portion having an outer diameter of said first dimension, said intermediate portion having an outer diameter of a fourth dimension which is smaller than said first dimension, said mandrel having a central section between said rearward section and said forward section, said central section having an outer diameter of said fourth dimension, said mandrel having a frusto conical expanding section extending from said central section where said expanding section has an outer diameter of said fourth dimension to said forward section where said expanding has an outer diameter of said second dimension;

(c) moving said press forwardly along said central longitudinal axis so that said mandrel extends through the bore of said billet and said central section lies within said third bore to form a first ring-shaped opening and the juncture of said central section and said forward portion is spaced rearward of said die when said forward pressing surface first engages said billet to push said billet against said die at said third bore;

(d) moving said press forwardly a first distance along said central longitudinal axis for forcing metal from said billet through said first ring-shaped opening to extrude a preliminary first end section of pipe having an outer diameter of said second dimension;

(e) moving said press forwardly along said central longitudinal axis a second distance with the forward portion of said rearward section within said third bore to form a second ring-shaped opening for forcing metal from said billet through said second ring-shaped opening to extrude the middle section of said pipe having an outer diameter of said second dimension and an inner diameter of said first dimension and causing said preliminary first end section of pipe to pass over the expanding section and forward section of said mandrel during forward movement of said press for said second distance so that the preliminary forward end section of said pipe is expanded transversely of said central longitudinal axis to an inner diameter of said first dimension and an outer of said third dimension;

(f) moving said press forwardly along said central longitudinal axis for a third distance with the intermediate portion of said rearward section within said third bore to form a third ring-shaped opening and the forward portion of said rearward section within said second bore to form a fourth ring-shaped opening for forcing metal from said billet through said third and fourth ring-shaped openings to extrude a preliminary second end section of said pipe while simultaneously causing said preliminary end section to pass over said forward portion so that said preliminary second section is expanded transversely of said central longitudinal axis to an inner diameter of said first dimension and an outer diameter of said third dimension;

(g) moving said press forwardly along said central longitudinal axis for a fourth distance with said rearward portion within said third bore to form said second ring-shaped opening for a second time for forcing metal from said billet through said second ring-shaped opening to form a tail end section of said pipe having the same inner and outer diameters of the middle section of said pipe while simultaneously forcing said preliminary second end section of said pipe over the forward section of said mandrel to complete the formation of the second section of said pipe;

(h) removing said extruded pipe from said mandrel; and (i) removing said tail end from said pipe.

* * * * *